US008596754B2

(12) United States Patent
Taira

(10) Patent No.: US 8,596,754 B2
(45) Date of Patent: Dec. 3, 2013

(54) LIQUID EJECTION APPARATUS

(75) Inventor: Hiroshi Taira, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/248,985

(22) Filed: Sep. 29, 2011

(65) Prior Publication Data

US 2012/0162311 A1 Jun. 28, 2012

(30) Foreign Application Priority Data

Dec. 28, 2010 (JP) ..... 2010-293917

(51) Int. Cl.
*B41J 2/165* (2006.01)

(52) U.S. Cl.
USPC ..... 347/30

(58) Field of Classification Search
USPC ..... 347/30
See application file for complete search history.

(56) References Cited

U.S. PATENT DOCUMENTS

| | | | | |
|---|---|---|---|---|
| 7,237,868 | B2 * | 7/2007 | Lim | 347/29 |
| 7,604,332 | B2 * | 10/2009 | Nagashima | 347/84 |
| 2009/0096830 | A1 * | 4/2009 | Shimazaki | 347/30 |
| 2009/0109257 | A1 * | 4/2009 | Shimazaki | 347/31 |
| 2010/0147891 | A1 * | 6/2010 | Yoshihisa | 222/192 |
| 2011/0242204 | A1 * | 10/2011 | Shinoda | 347/29 |

FOREIGN PATENT DOCUMENTS

| | | | |
|---|---|---|---|
| GB | 2280149 | * | 1/1995 |
| JP | 02006142 A | * | 1/1990 |
| JP | 2005-212138 A | | 8/2005 |

* cited by examiner

*Primary Examiner* — Matthew Luu
*Assistant Examiner* — Michael Konczal
(74) *Attorney, Agent, or Firm* — Baker Botts L.L.P.

(57) ABSTRACT

A liquid ejection apparatus including: a liquid ejection head that ejects ink through liquid ejection openings in a liquid ejection surface of the head, a cap device that establishes a sealing state, such that an ejection space opposed to the liquid ejection surface is sealed from an exterior space by the cap device, an air introduction opening and an air discharge opening that are located in the cap device, and a humidifier that supplies an humidified air into the ejection space through the air introduction opening and that discharges an air from the ejection space through the air discharge opening. The air discharge opening opens in an area other than a liquid discharge area onto which the ejected liquid is to be discharged. The apparatus further includes a flow restrainer that restrains the liquid discharged onto the liquid discharge area, from flowing to the air discharge opening.

23 Claims, 13 Drawing Sheets

LIQUID EJECTION APPARATUS

CROSS REFERENCE TO RELATED APPLICATION

This application claims priority from Japanese Patent Application No. 2010-293917, filed on Dec. 28, 2010, the disclosure of which is herein incorporated by reference in its entirety.

BACKGROUND OF THE INVENTION

Field of the Invention

The present invention relates to a liquid ejection apparatus for ejecting a liquid such as ink.

A liquid ejection apparatus is provided with a head having a liquid ejection surface defining liquid ejection openings through which a liquid such as ink is to be ejected. If a long time has elapsed without the liquid being ejected through the liquid ejection openings, the liquid in the vicinity of each of the liquid ejection openings is likely to be evaporated whereby viscosity of the ink could be increased. The increased viscosity of the ink could cause clogging of the liquid ejection openings. There is known a technique for preventing the clogging of the liquid ejection openings.

In the known technique, an ejection space, which is isolated from an exterior space, can be defined by causing the liquid ejection surface to be covered by a recess-shaped cap (capping portion). Further, a humidified air can be supplied into the ejection space through an air introduction opening provided in a bottom surface of the cap, and an air can be discharged from the ejection space through an air discharge opening provided in the bottom surface of the cap, by operation of an air conditioner device (humidifier) having an air passage including portions that define the air introduction opening and the air discharge opening. Owing to the operation of the air conditioner device, evaporation of the liquid in the vicinity of each of the liquid ejection openings can be restrained whereby clogging of each of the liquid ejection openings can be restrained.

SUMMARY OF THE INVENTION

However, in the above-described known technique, the air is discharged from the ejection space through the air discharge opening in a state in which the liquid deposits on the cap and the liquid ejection surface that faces the ejection space. Therefore, the liquid is likely to flow into the air discharge opening, together with discharge of the air from the ejection space, and the liquid having flowed into the air discharge opening could cause closing of the air discharge opening and/or deterioration of performance of the humidifier itself. Consequently, performance of the humidifying function in the liquid ejection apparatus could be deteriorated.

The present invention was made in view of the above-described background factors. It is therefore an object of the invention to provide a liquid ejection apparatus in which the liquid can be restrained from flowing into the air discharge opening so that the performance of the humidifying function can be restrained from being deteriorated.

The above object of the invention may be achieved according to a principle of the invention, which provides a liquid ejection apparatus including: (a) a liquid ejection head having a liquid ejection surface, and configured to eject ink through liquid ejection openings that open in the liquid ejection surface, for forming an image on a recording medium; (b) a cap device configured to establish a sealing state and an unsealing state, such that an ejection space opposed to the liquid ejection surface is sealed from an exterior space by the cap device when the sealing state is being established, and such that the ejection space is unsealed from the exterior space when the unsealing state is being established; (c) an air introduction opening and an air discharge opening that are located in the cap device; (d) a humidifier configured to supply an humidified air into the ejection space through the air introduction opening and to discharge an air from the ejection space through the air discharge opening; (e) the air discharge opening being provided to open in an area other than a liquid discharge area onto which the liquid ejected through the ejection openings is to be discharged when the sealing state is being established by the cap device; and (f) at least one flow restrainer configured to restrain the liquid having been discharged onto the liquid discharge area, from flowing to the air discharge opening.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENTS

There will be described liquid ejection apparatuses in the form of inkjet printers constructed according to embodiments of the invention, with reference to the accompanying drawings.

Figure 1:
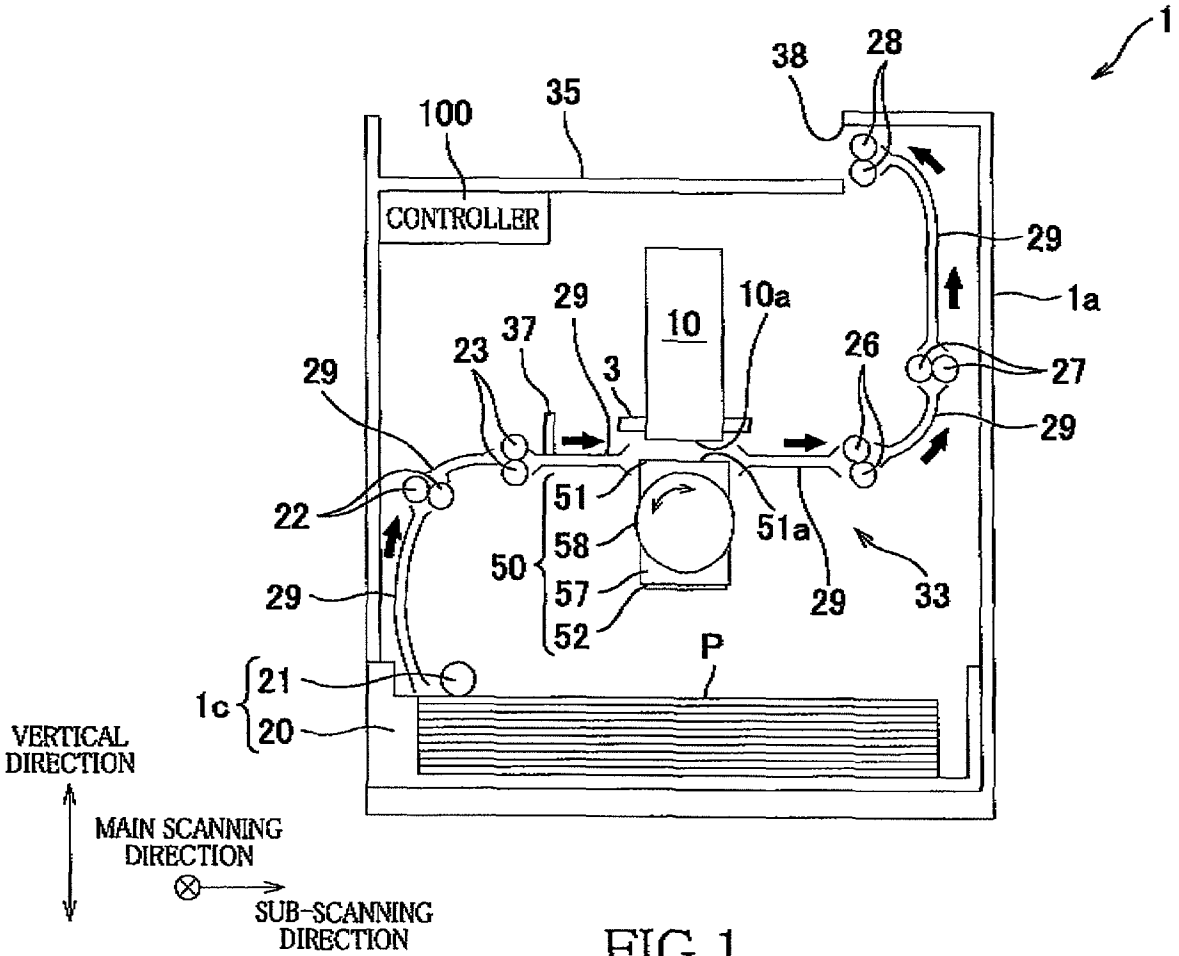
FIG. 1 is a side view schematically showing an overall construction of an inkjet printer that is constructed according a first embodiment of the invention.

FIG. 1 shows an overall construction of an inkjet printer 1 constructed according to a first embodiment of the invention.

The printer 1 has a generally rectangular parallelepiped-shaped housing body 1*a*. A sheet discharge portion 35 is provided on a top plate of the housing body 1*a*. In a space defined in the housing body 1*a*, there is a sheet conveyance path along which a recording medium in the form of a sheet P is to be conveyed, as indicated by thick arrows in FIG. 1, from a sheet supply unit 1*c* toward the sheet discharge portion 35.

The housing body 1*a* accommodates therein a head (liquid ejection head) 10, a sheet conveying mechanism 33, a support/cap unit 50, a humidifier unit 60 (see FIG. 5), a liquid suction unit 70 (see FIG. 5), a cartridge (not shown) and a controller 100. The sheet conveying mechanism 33 is configured to convey the sheet P such that the sheet P passes a position that is opposed to a liquid ejection surface 10*a* of the head 10. The support/cap unit 50 is disposed in a position opposed to the liquid ejection surface 10*a* of the head 10. The humidifier unit 60 is to be used for air humidification as a maintenance operation. The liquid suction unit 70 is configured to remove liquid or the like depositing on a liquid discharge area 81 of an opposed portion 53 of a recessed member 52 of the support/cap unit 50. The cartridge is provided for storing therein black ink that is to be supplied to the head 10. The controller 100 is configured to control activations of components of the printer 1.

The head 10 is a generally rectangular parallelepiped-shaped line head that is elongated in a main scanning direction. The head 10 has a lower surface constituting a liquid ejection surface 10*a* defining a multiplicity of liquid ejection openings 14*a* that open therein (see FIGS. 3 and 4). For performing an image recording (image forming) operation, the black ink is discharged through the liquid ejection openings 14*a* . Further, the head 10 is supported by the housing body 1*a* through a head holder 3, which holds the head 10 such that the liquid ejection surface 10*a* and a support surface 51*a* (described below) cooperate with each other to define therebetween a gap that is to be suitable for the image recording operation.

During a recording mode in which the ink is to be ejected toward the sheet P through the liquid ejection openings 14*a*, the controller 100 is configured to control, based on a print data transmitted from an external device, various activations of the components of the printer 1 for causing the sheet P to be conveyed and causing the inks to be ejected in synchronization with conveyance of the sheet P. During a maintenance mode in which the maintenance operations are to be carried out for the liquid ejection surface 10*a*, the controller 100 is configured to control various activations of the components of the printer 1 for recovering or maintaining performance of ejection of the ink.

The maintenance operations include: flushing (i.e., operation for causing the ink to be forcedly ejected through a part or all of the liquid ejection openings 14*a*, by activating all of actuators of the head 10 based on a flushing data that is different from an image data); purging (i.e., operation for causing the ink to be forcedly ejected through all of the liquid ejection openings 14*a*, by activating a purging mechanism 8 (see FIG. 7) for pressurizing the ink within the head 10); wiping (i.e., operation for removing foreign substance (e.g., ink) from the liquid ejection surface 10*a* by a wiper 9 (see FIG. 7)); air humidification (i.e., operation for supplying humidified air into an ejection space S1 (see FIG. 5) that is to be sealed by cooperation of the liquid ejection surface 10*a* of the head 10 and the recessed member 52); and liquid suction (i.e., operation for removing the ink depositing on the liquid discharge area 81 by sucking the ink). The purging and flushing, which will be hereinafter referred to as forced ink-ejection, are carried out in a case where no ink has been ejected through the liquid ejection openings 14*a* for at least a given length of time, so that thickened ink (i.e., ink whose viscosity has been increased) and air bubbles remaining in the liquid ejection openings 14*a* can be discharged together with the ink.

The sheet conveying mechanism 33 has a sheet supply unit 1*c*, a guide 29, pairs of convey rollers 22, 26, 27, 28 and a pair of register rollers 23, and defines a sheet conveyance path along which the sheet P is to be conveyed from the sheet supply unit 1*c* to the sheet discharge portion 35. The sheet supply unit 1*c*, convey rollers 22, 26, 27, 28 and register rollers 23 axe controlled by the controller 100.

The sheet supply unit is has a sheet supply tray (sheet storage) 20 and a sheet supply roller 21. The sheet supply tray 20 is attached to the housing body 1*a*, and is removable from the housing body 1*a* by displacing the tray 20 away from the housing body 1*a* in a sub-scanning direction. The sheet supply tray 20 is constituted by a box having an upper opening, and is capable of storing therein the sheets P. The sheet supply roller 21 is to be rotated, under control by the controller 100, for supplying an uppermost one of the sheets P stored in the sheet supply tray 20.

The sub-scanning direction is parallel to a sheet conveyance direction in which sheet P is to be conveyed by the sheet conveying mechanism 33. Meanwhile, the main scanning direction is parallel to a horizontal plane and is perpendicular to the sub-scanning direction.

The sheet P, which has been supplied from the sheet supply tray 20 by the sheet supplying roller 21, is supplied to the pair of register rollers 23, while being guided by the guide 29 and gripped between the pair of convey rollers 22. The sheet P, which has been supplied from the pair of convey rollers 22, is gripped at its leading end portion by the pair of register rollers 23 without rotations of the rollers 23 for a registering time as a given length of time, whereby inclination of the sheet P (i.e., inclination of the conveyance direction of the sheet P) can be corrected while the leading end portion of the sheet P is being gripped by the register rollers 23. Then, when the registering time has elapsed, the register rollers 23 are rotated whereby the sheet P (whose inclination has been corrected) is conveyed toward the above-described gap between the head 10 and the support/cap unit 50.

The sheet P, which has been supplied to the gap between the head 10 and the support/cap unit 50 by the register rollers 23, is subjected to the image recording operation, when passing right below the head 10 in the sub-scanning direction, so that a monochrome image is formed on the sheet P by the ink ejected sequentially through the liquid ejection openings 14*a*. The ejection of the ink through the liquid ejection openings 14*a* is made based on signals supplied from a sheet sensor 37, under control by the controller 100. The sheet P is then conveyed upwardly, while being guided by the guide 29 and gripped between the pairs of rollers 26, 27, 28. The sheet P is eventually discharged to the sheet discharge portion 35 via an opening 38 that is provided in an upper portion of the housing body 1*a*.

Figure 2:
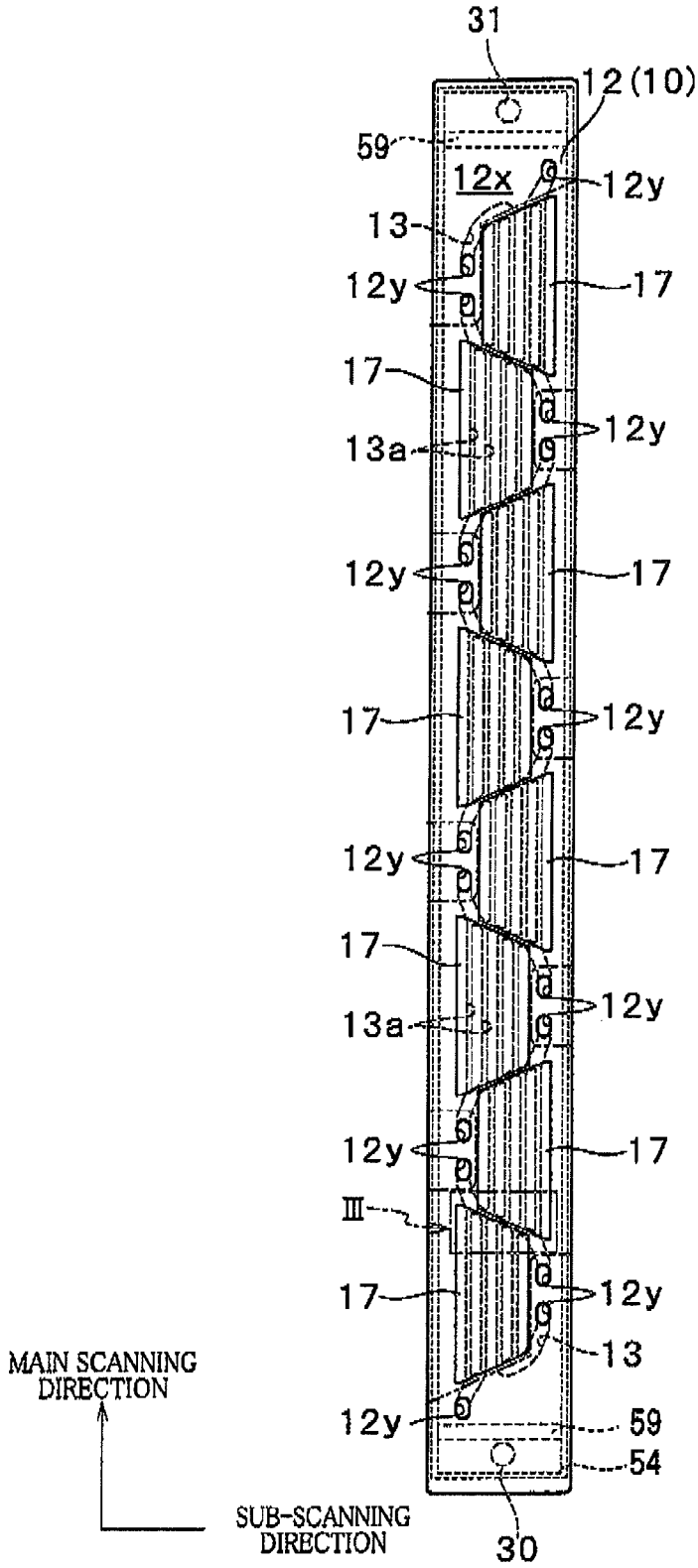
FIG. 2 is a plan view showing a flow passage unit, an actuator unit and a recessed member of a liquid ejection head of the printer of FIG. 1.
Figure 3:
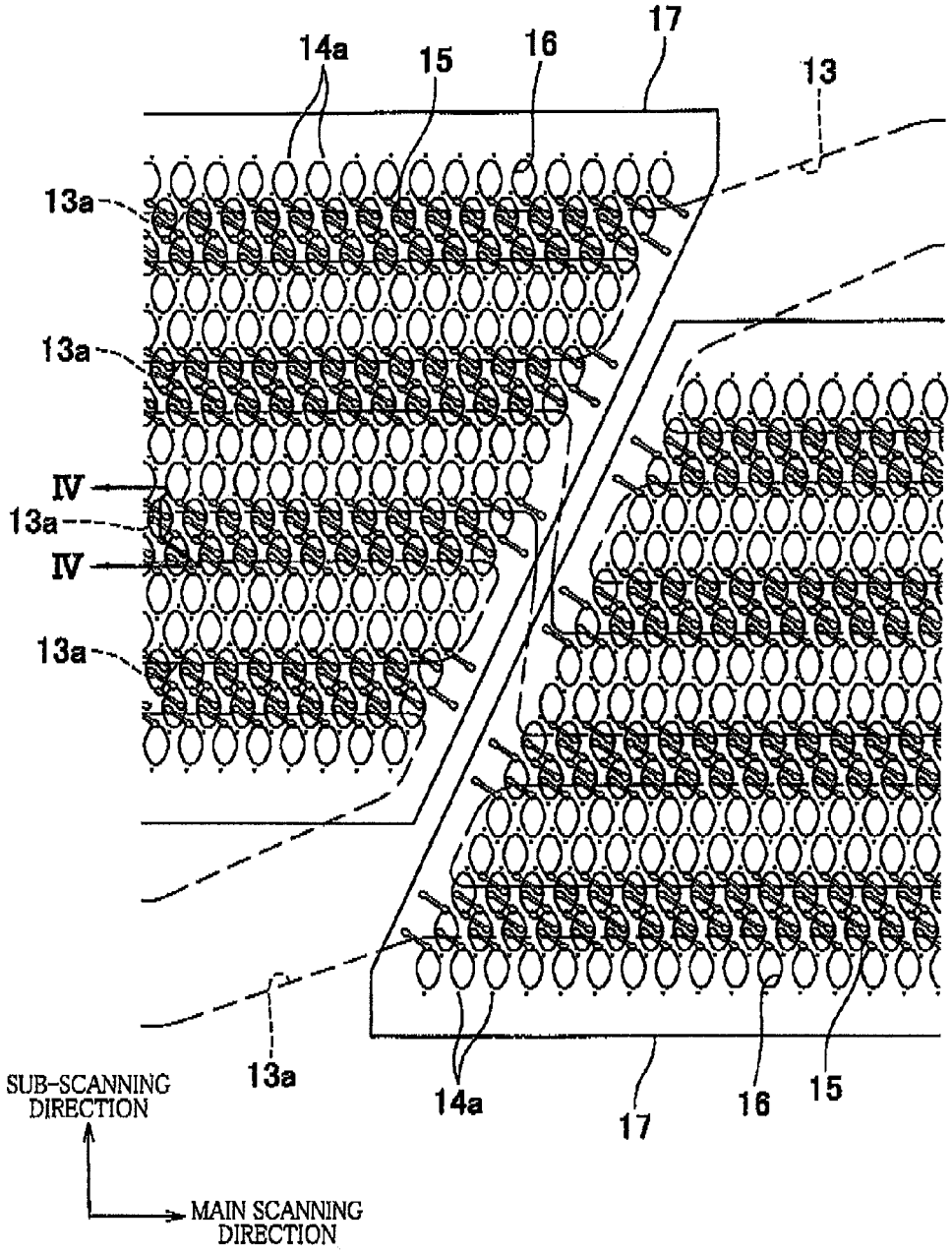
FIG. 3 is an enlarged view showing a region III that is surrounded by one-dot chain line in FIG. 2.
Figure 4:
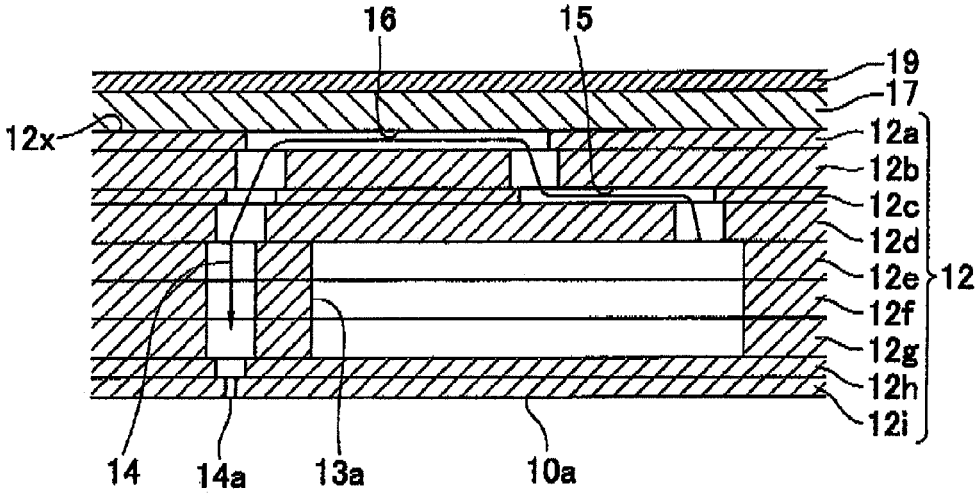
FIG. 4 is a cross-sectional view showing a cross section that is taken along line IV-IV in FIG. 3.

Referring next to FIGS. 2-4, there will be described construction of the head 10. It is noted that, in FIG. 3, pressure chambers 16 and apertures 15 which are located on a lower side of each actuator unit 17 are represented by solid lines in place of broken lines.

The head 10 has a reservoir unit 11 (see FIG. 5), a flow passage unit 12 (see FIG. 4), eight actuator units 17 (see FIG. 2) fixed to an upper surface 12*x* of the flow passage unit 12, and FPC (flexible printed circuit) 19 (see FIG. 4) connected to each of the actuator units 17. The reservoir unit 11 defines therein an ink flow passage including a reservoir for temporarily storing therein the ink supplied from a cartridge. The flow passage unit 12 defines therein an ink flow passage extending from each opening 12*y* (see FIG. 2) that is provided in the upper surface 12*x*, to the liquid ejection openings 14*a* that are provided in the liquid ejection surface 10*a* as a lower surface of the flow passage unit 12. Each of the actuator units 17 has piezoelectric actuators provided for the respective liquid ejection openings 14*a*.

There are recessed and protruding portions that are provided in a lower surface of the reservoir unit 11. The protruding portions are bonded to portions (i.e., areas each including the corresponding opening 12*y* and surrounded by two-dot chain line, as shown in FIG. 2) of the upper surface 12*x* of the flow passage unit 12 in which the actuator units 17 are not located. Each of the protruding portions has an opening which is held in communication with the reservoir and which is opposed to the corresponding opening 12*y* of the flow passage unit 12, so that the reservoir is held in communication with individual passage sections 14 via the openings of the protruding portions. Meanwhile, the recessed portions are opposed to the upper surface 12*x* of the flow passage unit 12, surfaces of the actuator units 17 and a surface of the FPC 19, with a small gap between each recessed portion and a corresponding one of these surfaces.

The flow passage unit 12 is constituted by a laminated body including a total of nine rectangular-shaped metal plates 12*a*, 12*b*, 12*c*, 12*d*, 12*e*, 12*f*, 12*g*, 12*h*, 12*i* (see FIG. 4) which have substantially the same size and which are bonded to one another. As shown in FIGS. 2, 3 and 4, the ink flow passage of the flow passage unit 12 includes manifold passage sections 13 and sub-manifold passage sections 13*a* in addition to the above-described individual passage sections 14. Each of the manifold passage sections 13 has an end portion that corresponds to the corresponding opening 12*y*. The sub-manifold passage sections 13*a* are sections branching off from the manifold passage sections 13. The individual passage sections 14 extend from outlets of the sub-manifold passage sections 13*a* to the liquid ejection openings 14*a* via the pressure chambers 16. The metal plate 12*c*, as one of the nine metal plates 12*a*-12*i*, has the above-described apertures 15 (see FIG. 4) each of which serves as a flow restrictor or regulator that is provided in a corresponding one of the individual passage sections 14, for adjusting resistance applied to flow in the corresponding individual passage section 14 held in communication with the corresponding liquid ejection opening 14*a*. In each of portions of the upper surface 12*x* to which the respective actuator units 17 are to be bonded, generally diamond-shaped openings (for exposing the respective pressure chambers 16) are provided, such that the diamond-shaped openings are arranged in a matrix pattern. In each of portions of the lower surface (i.e., liquid ejection surface 10*a*) that are substantially aligned with the above-described portions of the upper surface 12*x* (to which the actuator units 17 are bonded), the liquid ejection openings 14*a* are arranged in a matrix pattern that is substantially the same as the above-described matrix pattern of the arrangement of the diamond-shaped openings of the pressure chambers 16.

As shown in FIG. 2, the actuator units 17, each having a trapezoidal shape in its plan view, are disposed on the upper surface 12*x* of the flow passage unit 12 and are arranged in two rows in a staggered manner. As shown in FIG. 3, the above-described generally diamond-shaped openings of the respective pressure chambers 16 provided in the above-described portions of the upper surface 12*x* (to which the actuator units 17 are bonded) are covered by the actuator units 17. Each of the actuator units 17 includes a plurality of piezoelectric layers straddling over the multiplicity of pressure chambers 16, and also electrodes that are disposed on opposite sides of each of the piezoelectric layers in the thickness direction. The electrodes include individual electrodes provided for the respective pressure chambers 16, and also a common electrode common to the pressure chambers 16. The individual electrodes are disposed on an uppermost one of the piezoelectric layers.

The FPC 19 has wires corresponding to the electrodes of the actuator unit 17, and each of the wires is provided with a driver IC (not shown) that is disposed in its halfway portion. The FPC 19 is fixed at one of its opposite end portions to the actuator unit 17, and is fixed at the other of its opposite end portions to a control board (not shown) of the head 10, which is located above the reservoir unit 11. The FPC 19 is configured to transmit drive signals outputted from the control board under control by the controller 100 (see FIG. 1), to the driver IC. Further, the FPC 19 is configured to transmit signals generated by the driver IC, to the actuator unit 17.

The support/cap unit 50 will be described in detail with reference to FIGS. 1, 2, 5 and 6.

As shown in FIG. 1, the support/cap unit 50 is disposed in a position that is opposed to the liquid ejection surface 10*a* of the head 10 in a vertical direction. The support/cap unit 50 includes a rotary body 58 that is rotatable, about an axis parallel to the main scanning direction, under control by the controller 100. The support/cap unit 50 further includes a platen 51 and a cap fixing member 57 that are fixed to a peripheral surface of the rotary body 58, a recessed member 52 that is fixed to the cap fixing member 57, and a rotary-body elevating mechanism 56 (see FIG. 7) configured to vertically move the rotary body 58.

The platen 51 has a size slightly larger than a size of the liquid ejection surface 10*a*, as measured in the main scanning direction and the sub-scanning direction. The platen 51 is disposed to be opposed to the cap fixing member 57 in the vertical direction. The platen 51 has a surface serving as the above-described support surface 51*a* which is to be opposed to the liquid ejection surface 10*a* and which is to support the sheet P. The support surface 51*a* is made of a material suitable for supporting the sheet P, and has a shape suitable for supporting the sheet P. For example, a silicon layer having a certain degree of bonding property may be formed on the support surface 51*a*, or a multiplicity of ribs extending in the sub-scanning direction may be provided on the support surface 51*a*, for preventing upward separation of the sheet P from the support surface 51*a*. It is noted that the platen 51 is made of resin.

Figure 5:
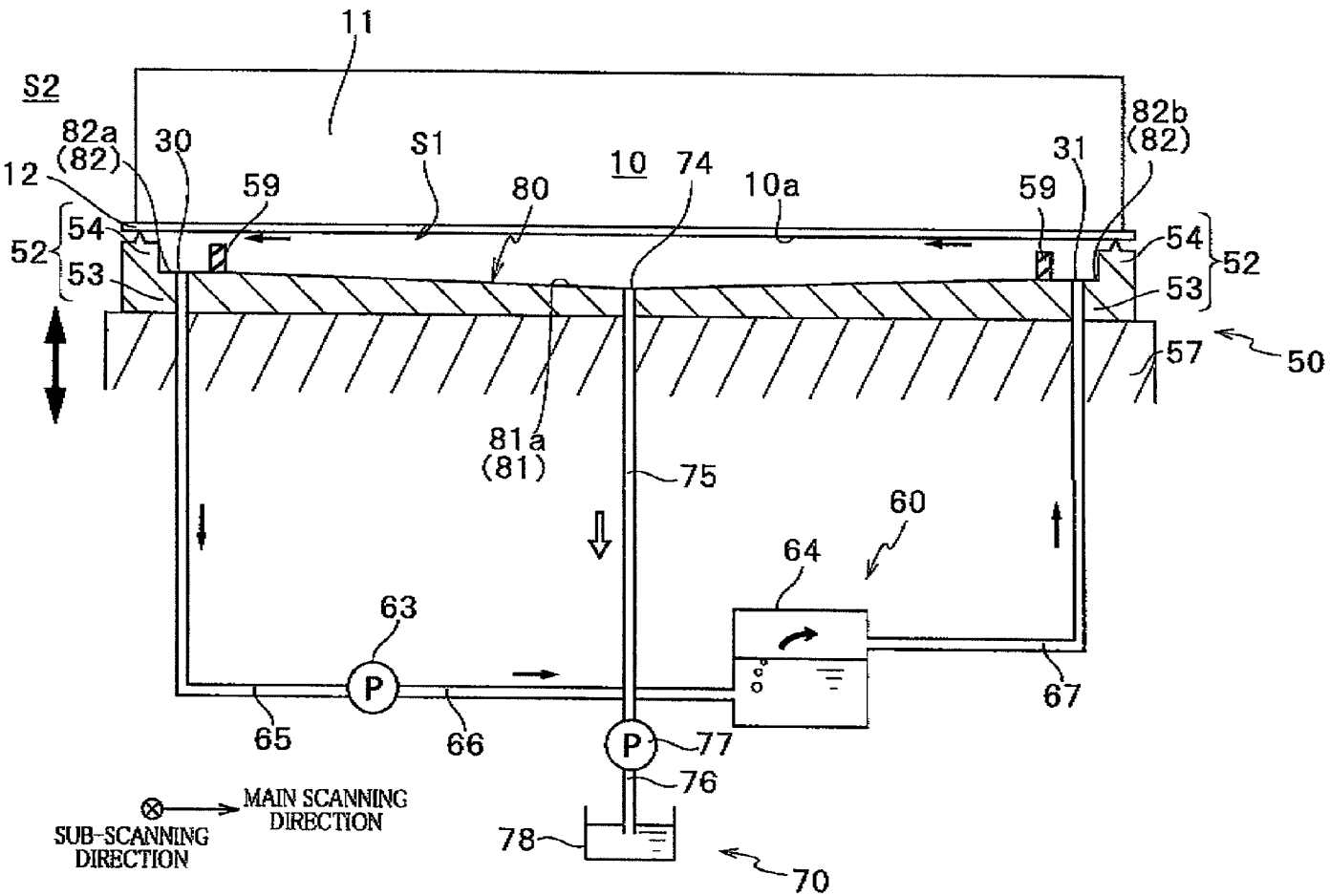
FIG. 5 is a view schematically showing the liquid ejection head, the recessed member, a humidifier unit and a liquid suction unit of the printer.

The rotary body 58 is to be rotated to be positioned selectively in a first angular position (see FIG. 1) and a second angular position, under control by the controller 100. When the rotary body 58 is being positioned in the first angular position, the support surface 51*a* is opposed to the liquid ejection surface 10*a* while an opposed surface 80 (described below) is not opposed to the liquid ejection surface 10*a* . When the rotary body 58 is being positioned in the second angular position after having been rotated from the first angular position by 180[deg], the support surface 51*a* is not opposed to the liquid ejection surface 10*a* while the opposed surface 80 is opposed to the liquid ejection surface 10*a* , as shown in FIG. 5. In the present embodiment, the controller 100 controls rotation of the rotary body 58, such that the rotary body 58 is being positioned in the first angular position during the recording mode and during a recording-standby mode for waiting for a print command, and such that the rotary body 58 is being positioned in the second angular position during the maintenance mode.

The rotary body 58 has a shaft serving as the above-described axis about which the rotary body 58 is rotatable. The shaft of the rotary body 58 is held by the rotary-body elevating mechanism 56, which is controlled, by the controller 100, to vertically move the rotary body 58. The recessed member 52, which is fixed to the rotary body 58 via the cap fixing member 57, is vertically moved together with the vertical movement of the rotary body 58, thereby changing a position of the recessed member 52 relative to the liquid ejection surface 10*a* in the vertical direction. It is noted that the rotary-body elevating mechanism 56 may be constituted by, for example, a rack and pinion or a solenoid (i.e., device that converts energy into linear motion).

As shown in FIGS. 5 and 6, the recessed member 52 is constituted by the above-described opposed portion 53 (that is opposed to the liquid ejection surface 10*a*) and a peripheral portion 54 that is formed integrally with the opposed portion 53, and is fixed to the cap fixing member 57. The peripheral portion 54 is provided in a periphery of the opposed portion 53, and is made of an elastic material such as a rubber. As shown in FIG. 2, the peripheral portion 54 surrounds all of the actuator units 17, namely, surrounds all of the liquid ejection openings 14*a* opening in the liquid ejection surface 10*a*, as seen in a direction perpendicular to the liquid ejection surface 10*a*.

Figure 6A:
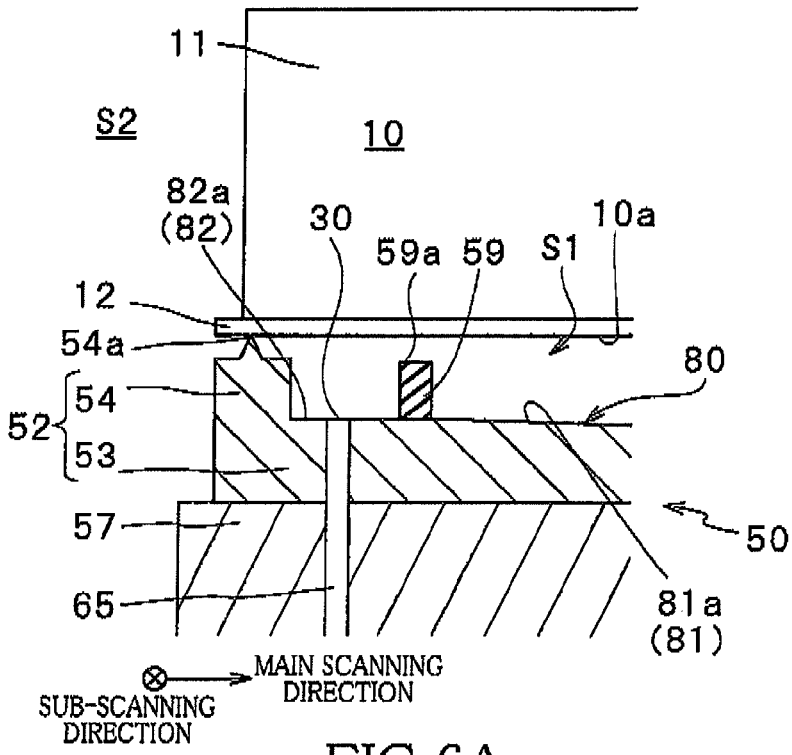
FIG. 6A is a view schematically showing a positional relationship between the recessed member and a liquid ejection surface of the liquid ejection head of the printer of FIG. 1 when the recessed member is being positioned in its contact position.
Figure 6B:
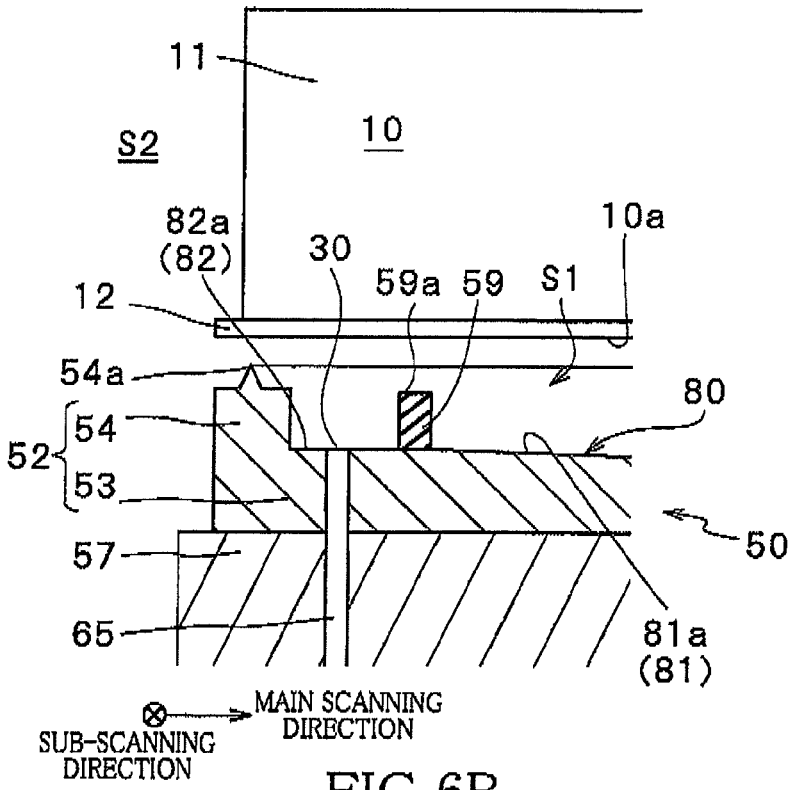
FIG. 6B is a view schematically, showing the positional relationship between the recessed member and the liquid ejection surface when the recessed member is being positioned in its separation position.

While the opposed surface 80 is opposed to the liquid ejection surface 10*a*, the recessed member 52 can be positioned selectively in a contact position (see FIG. 6A) and a separation position (see FIG. 6B), by vertical movement of the rotary body 58 by the rotary-body elevating mechanism 56. When the opposed surface 80 is being positioned in the contact position, the peripheral portion 54 is contact at its distal end 54*a* with the liquid ejection surface 10*a* of the head 10. When the opposed surface 80 is being positioned in the separation position, the distal end 54*a* of the peripheral portion 54 is separated from the liquid ejection surface 10*a* of the head 10. When the recessed member 52 is being positioned in the contact position as shown in FIG. 6A, the ejection space S1 opposed to the liquid ejection surface 10*a* is isolated or sealed from an exterior space S2, by cooperation of the recessed member 52 and the liquid ejection surface 10*a*. When the recessed member 52 is being positioned in the separation position as shown in FIG. 6B, the ejection surface S1 opposed to the liquid ejection surface 10*a* is not isolated or sealed from the exterior space S2. In the present embodiment, as is clear from the above description, the recessed member 52, rotary-body elevating mechanism 56 and controller 100 cooperate to constitute a cap device configured to establish a sealing state (in which the recessed member 52 is being positioned in the contact position) and an unsealing state (in which the recessed member 52 is being positioned in the separation position), such that the ejection space S1 is isolated or sealed from the exterior space S2 by the cap device when the sealing state is being established, and such that the ejection space S1 is unsealed from the exterior space S2 when the unsealing state is being established. Further, in the present embodiment, the cap device has a simple construction for establishing selectively the sealing state and the unsealing state, by simply causing the vertical movement of the recessed member 52 constituted by the opposed portion 53 and the peripheral portion 54 that are formed integrally with each other.

The opposed portion 53 is made of a glass, a metal (e.g., SUS) or other material that does not or little absorb moisture. The opposed surface 80 is sectioned into the liquid discharge area 81 and an outer peripheral area 82 that surrounds the liquid discharge area 81. The liquid discharge area 81 is an area onto which the ink discharged (forcedly ejected) through the liquid ejection openings 14*a* is to be delivered (caused to deposit or land) when the opposed surface 80 is being opposed to the liquid ejection surface 10*a*, namely, when the sealing state is being established. The outer peripheral area 82 is an area onto which the ink ejected through the liquid ejection openings 14*a* is not to be delivered (caused to deposit or land), and is constituted mainly by a pair of outside areas 82*a*, 82*b* that are located on respective opposite sides of the liquid discharge area 81 in the main scanning direction and also another pair of outside areas (not shown) that are located on respective opposite sides of the liquid discharge area 81 in the sub-scanning direction.

A liquid suction opening 74 is provided in a central portion of the liquid discharge area 81, so that the ink having been ejected to deposit on the liquid discharge area 81 can be discharged out from the ejection space S1 via the liquid suction opening 74 when the liquid suction is carried out. It is noted that the liquid suction opening 74 does not necessarily have to be provided in the central portion of the liquid discharge area 81 but may be provided in a portion other than the central portion.

A flow restraining plate 59 is provided at a boundary between the outside area 82*a* and the liquid discharge area 81 while another flow restraining plate 59 is provided at a boundary between the outside area 82*b* and the liquid discharge area 81. Each of the flow restraining plates 59 extends in the sub-scanning direction between inside surfaces of opposite end portions of the peripheral portion 54, which are opposite to each other in the sub-scanning direction, so that the pair of flow restraining plates 59 cooperate with the peripheral portion 54 to surround the liquid discharge area 81. In the present embodiment, each of the flow restraining plates 59 constitutes a protrusion wall, and the pair of flow restraining plates 59 cooperate with the peripheral portion 54 to constitute a surrounding portion.

Each of the flow restraining plates 59 has a vertical length smaller than a vertical length of the peripheral portion 54, as shown in FIGS. 6A and 6B. That is, a distal end 59*a* of each of the flow restraining plates 59 is located on a lower side of the distal end 54*a* of the peripheral portion 54 in the sealing state.

An air discharge opening 30 is located in the outside area 82*a* of the opposed surface 80, while an air introduction opening 31 is located in the outside area 82*b* of the opposed surface 80. When the above-described air humidification is carried out, an air having humidified in a tank 64 (described below) is supplied into the ejection space S1 through the air introduction opening 31, and an air having stayed in the ejection space S1 is discharged out from the ejection space S1 through the air discharge opening 30.

Since the air discharge opening 30 and the air introduction opening 31 are located in the respective outside areas 82*a*, 82*b*, as described above, the air introduction opening 31 and the air discharge opening 30 are positioned in respective positions, which are located on respective opposite sides of an ejection-opening portion of the liquid ejection surface 10*a* (in which the liquid ejection openings 14*a* are located) as seen in a direction perpendicular to the liquid ejection surface 10*a*, when the recessed member 52 is being positioned in the contact position, namely, when the sealing state is being established. Owing to this positional relationship, during the air humidification, the air within the ejection space S1 flows away from one of opposite ends of the liquid ejection surface 10*a* toward the other of the opposite ends of the liquid ejection surface 10*a* in the main scanning direction, so that the air within the ejection space S1 can be efficiently humidified. Consequently, it is possible to restrain evaporation of the ink staying in the vicinity of each of the liquid ejection openings 14*a* and also restrain clogging of each of the liquid ejection openings 14*a*.

Further, since each of the flow restraining plates 59 is disposed between the liquid discharge area 81 and a corresponding one of the air discharge opening 30 and the air introduction opening 31, it is possible to restrain the ink (depositing on the liquid discharge area 81) from flowing to the air discharge opening 30 and the air introduction opening 31 that open in the respective outside areas 82*a*, 82*b*.

Further, as shown in FIG. 5, a recessed portion 81*a* is provided in the liquid discharge area 81 of the opposed surface 80. The recessed portion 81*a*. The recessed portion 81*a* is inclined downwardly from a peripheral portion of the liquid discharge area 81 toward the liquid suction opening 74 that is provided in a central portion of the liquid discharge area 81. That is, the recessed portion 81*a* has a sloped surface such that a central portion of the sloped surface is located on a lower side of a peripheral portion of the sloped surface. Owing to the sloped surface of the recessed portion 81*a*, which is sloped toward the liquid suction opening 74, the ink depositing on the liquid discharge area 81 is caused to flow toward the liquid suction opening 74 that is located on a lower aide of the peripheral portion of the liquid discharge area 81 in a gravitational direction. It is therefore possible to restrain the ink depositing on the liquid discharge area 81, from flowing into the air discharge opening 30 and the air introduction opening 31 opening in the outside area 82, and also to facilitate the ink (depositing on the liquid discharge area 81) to be sucked via the liquid suction opening 74 when the liquid suction is carried out. In the present embodiment, the recessed portion 81*a* provided in the liquid discharge area 81 constitutes a flow restrainer.

Referring next to FIG. 5, there will be described construction of the humidifier unit 60.

The humidifier unit 60 includes tubes 65, 66, 67 (cooperating to constitute a circular passage), a circulating pump 63 and a tank 64, as shown in FIG. 5. The tube 65 is connected at one of its opposite end portions to the air discharge opening 30 that opens in the outside area 82*a* of the opposed surface 80, and is connected at the other of its opposite end portions to the circulating pump 63. The tube 66 is connected at one of its opposite end portions to the circulating pump 63, and is connected at the other of its opposite end portions to the tank 64. The tube 67 is connected at one of its opposite end portions to the air introduction opening 31 that opens in the outside area 82*b* of the opposed surface 80, and is connected at the other of its opposite end portions to the tank 64.

The tank 64 stores water in its lower space, and also stores humidified air in its upper space. The humidified air stored in the upper space is air humidified by the water stored in the lower space of the tank 64. The tube 66 is connected to a portion of the tank 64 which is located on a lower side of a level of the water stored in the tank 64, so that the tube 66 is held in communication with the lower space of the tank 64. The tube 67 is connected to a portion of the tank 64 which is located on an upper side of the level of the water stored in the tank 64, so that the tube 67 is held in communication with the upper space of the tank 64. The circulating pump 63 is controlled, by the controller 100, to induce air circulation between the ejection space S1 and the tank 64, so that the air is collected from the ejection space S1 via the air discharge opening 30 and the tubes 65, 66, and the collected air is humidified in the tank 64. Thus, the humidified air can be supplied into ejection space S1 via the tube 67 and the air introduction opening 31. Further, since the air is circulated among the ejection space S1, circulating pump 63 and tank 64, the air having relatively high humidity is reused so as to be repeatedly humidified, thereby making it possible to reduce cost required for a humidification source. It is noted that a check valve (not shown) is provided in the tube 66, so as to allow flow of the air only in a direction indicated by black arrow in FIG. 5, for thereby avoiding the water stored in the tank 64 from flowing into the circulating pump 63. In the present embodiment, the circulating pump 63, tank 64 and controller 100 cooperate to constitute a humidifier, and the tank 64 constitutes a portion of the humidifier which has a function for humidifying the air and which is provided in the circular passage.

Referring next to FIG. 5, there will be described construction of the liquid suction unit 70.

The liquid suction unit 70 includes suction tube 75, 76, a suction pump 77 and a waste liquid tank 78, as shown in FIG. 5. The suction tube 75 is connected at one of its opposite end portions to the liquid suction opening 74 that is provided in the central portion of the liquid discharge area 81 of the opposed surface 80, and is connected at the other of its opposite end portions to the suction pump 77. The suction tube 76 is connected at one of its opposite end portions to the suction pump 77, and is connected at the other of its opposite end portions to the waste liquid tank 78. The suction pump 77 is controlled, by the controller 100, to suck the ink depositing on the liquid discharge area 81, and to discharge the ink to the waste liquid tank 78 via the liquid suction opening 74 and the suction tubes 75, 76. In the present embodiment, the liquid suction unit 70 and the controller 100 cooperate to constitute a liquid sucker.

Figure 7:
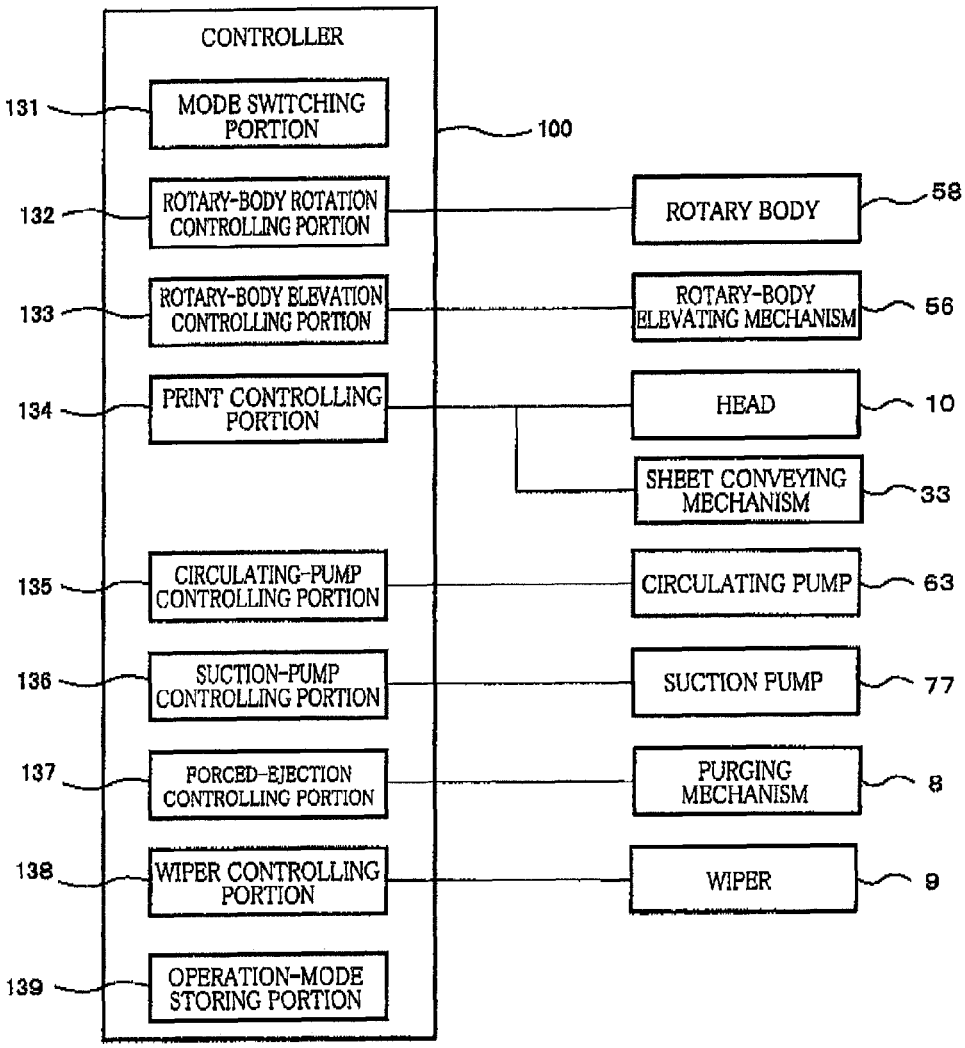
FIG. 7 is a block diagram showing electrical interconnections between components of the printer of FIG. 1.

Referring next to FIG. 7, the controller 100 will be described more in detail. The controller 100 includes CPU (Central Processing Unit), ROM (Read Only Memory) storing programs (that are to be executed by the CPU) and data (that axe to be used in the execution of the programs) such that the stored programs and data are rewritable, and RAM temporarily storing the data in the execution of the programs. With the control programs (stored in the ROM) being executed by the CPU, each functional portion (see FIG. 7) constituting the controller 100 is caused to perform the corresponding task. The controller 100 is capable of transmitting and receiving data to and from external devices such as PC (personal computer) connected to the printer 1, via I/Fs.

As shown in FIG. 7, the controller 100 is configured to control the entirety of the printer 1, and has a mode switching portion 131, a rotary-body rotation controlling portion 132, a rotary-body elevation controlling portion 133, a print controlling portion 134, a circulating-pump controlling portion 135, a suction-pump controlling portion 136, a forced-ejection controlling portion 137, a wiper controlling portion 188 and an operation-mode storing portion 139 storing a selected one of operation modes of the printer 1.

The mode switching portion 131 is configured to change the selected operation mode that is stored in the operation-mode storing portion 139. In other words, the mode switching portion 131 is configured to switch from one of the operation modes to another one of the operation modes. For example, when receiving the print command from the external device, the mode switching portion 131 establishes the recording mode as the selected one of the recording modes. When an image recording, which has been carried out in response to the print command, is completed, the mode switching portion 131 switches from the recording mode to the recording-standby mode. Further, when a given length of time has elapsed without reception of the print command after completion of the image recording, the mode switching portion 131 establishes the maintenance mode as the selected one of the recording modes.

When the mode switching portion 131 switches the operation mode stored in the operation-mode storing portion 139, from the recording-standby mode to the maintenance mode, the rotary-body rotation controlling portion 132 is configured to control rotation of the rotary body 58 such that the rotary body 58 is rotated from the first angular position to the second angular position. When the mode switching portion 131 switches the operation mode stored in the operation-mode storing portion 139, from the maintenance mode to the recording mode, the rotary-body rotation controlling portion 132 is configured to control rotation of the rotary body 58 such that the rotary body 58 is rotated from the second angular position to the first angular position.

The rotary-body elevation controlling portion 133 is configured to vertically move the rotary body 58, by controlling the rotary-body elevating mechanism 56. For example, when the mode switching portion 131 switches the operation mode stored in the operation-mode storing portion 139, from the recording-standby mode to the maintenance mode, the rotary-body elevation controlling portion 133 is configured to causes the rotary body 58 to be moved upwardly such that the recessed member 52 is placed from the separation position (see FIG. 6B) to the contact position (see FIG. 6A). When the mode switching portion 131 switches the operation mode stored in the operation-mode storing portion 139, from the maintenance mode to the recording mode, the rotary-body elevation controlling portion 133 is configured to causes the rotary body 58 to be moved downwardly such that the recessed member 52 is placed from the contact position to the separation position.

The print controlling portion 134 is configured, when the recording mode is currently stored in the operation-mode storing portion 139, to carry out the image recording, by controlling the head 10 and the sheet conveying mechanism 33 such that the ink is ejected onto the sheet P in accordance with the print data (i.e., data indicative of ejection of the ink from the head 10) that is supplied together with the print command from the external device.

The circulating-pump controlling portion 135 is configured, when the maintenance mode is currently stored in the operation-mode storing portion 139, to carry out the air humidification, by controlling activation of the circulating pump 63 such that the air within the ejection space S1 is humidified.

The suction-pump controlling portion 136 is configured, when the circulating pump 63 is being activated under control by the circulating-pump controlling portion 135, for example, during the air humidification, to carry out the liquid suction, by activating the suction pump 77 such that the ink depositing on the liquid discharge area 81 can be sucked.

When the mode switching portion 131 switches the operation mode stored in the operation-mode storing portion 139, from the maintenance mode to the recording mode, for example, the forced-ejection controlling portion 137 is configured to carry out the forced ink-ejection, by controlling the purging mechanism 8 such that the ink is purged from the head 10 toward the liquid discharge area 81 of the opposed surface 80.

When the forced ink-ejection as the maintenance operation by the forced-ejection controlling portion 137 is completed, the wiper controlling portion 138 is configured to control the wiper 9 such that foreign substances can be wiped from the liquid ejection surface 10*a* by the wiper 9. It is noted that the wiper 9 is constituted by a plate-like body which is made of a rubber or other elastic body and which is elongated in the sub-scanning direction. The wiper controlling portion 138 causes the wiper 9 to be moved in the main scanning direction with the wiper 9 being held in contact with the liquid ejection surface 10*a*, for thereby wiping the foreign substances (e.g., ink) from the liquid ejection surface 10*a*.

The operation-mode storing portion 139 is configured to store therein a selected on of the recording mode, recording-standby mode and maintenance mode.

Figure 8:
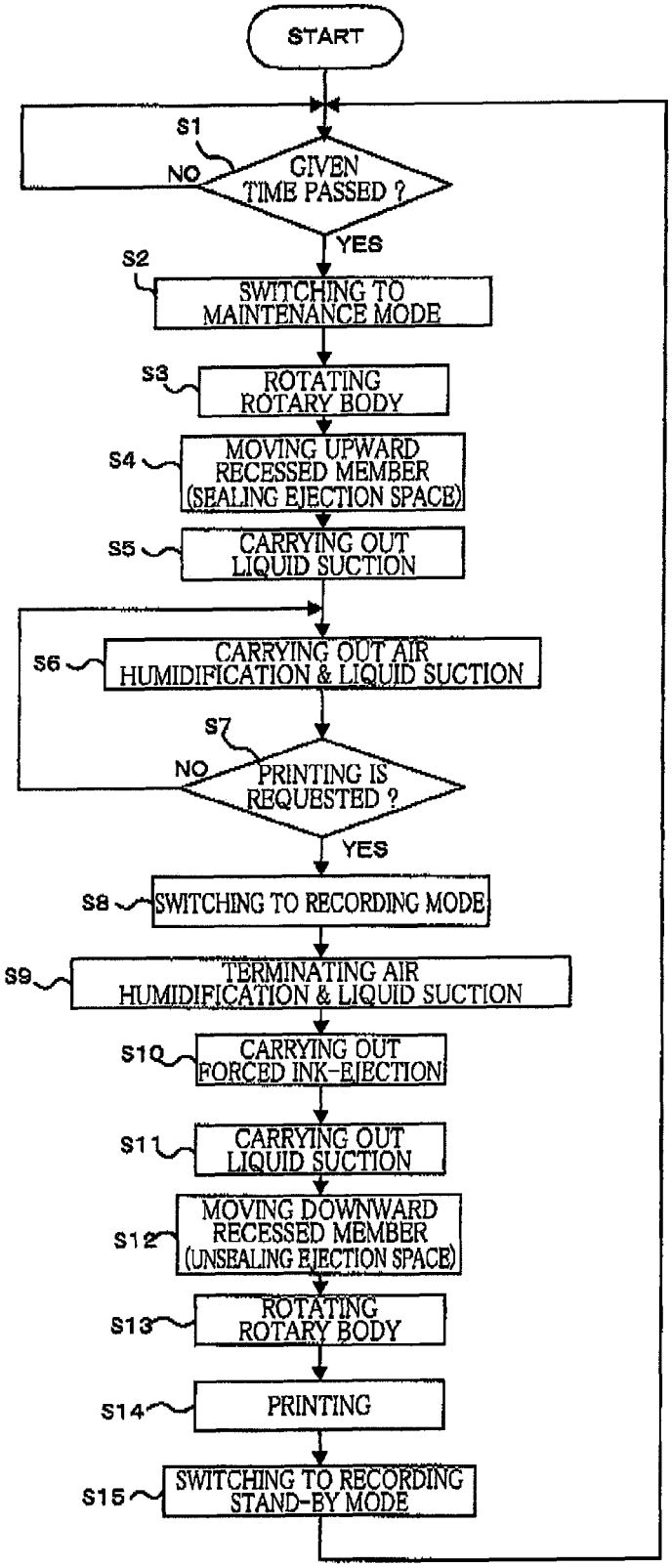
FIG. 8 is a flow chart showing a control flow that is to be executed by a controller of the printer of FIG. 1 so as to carry out maintenance operations such as air humidification and liquid suction.

Referring next to FIG. 8, there will be described a control routine that is to be carried out in the printer 1, for performing the maintenance operations in the form of the air humidification and the liquid suction. It is noted that, when the control routine of FIG. 8 starts, the recording-standby mode is initially stored as the selected operation mode in the operation-mode storing portion 139.

The control flow is initiated with step S1 in which it is judged by the mode switching portion 131 whether a given length of time has passed since the image recording had been completed by the print controlling portion 134. As long as it is judged that the given length of time has not yet passed, namely, as long as a negative judgment (NO) is obtained in step S1, step S1 is repeatedly implemented. It is noted that, if the print command is received from the external device before the given length of times passes, the mode switching portion 131 switches the operation mode stored in the operation-mode storing portion 139, from the recording-standby mode to the recording mode, so that the image recording is carried out by the print controlling portion 184 in response to the print command.

On the other hand, when it is judged that the given length of time has passed, namely, when a positive judgment (YES) is obtained in step S1, the control flow goes to step S2 in which the mode switching portion 131 switches the operation mode stored in the operation-mode storing portion 139, from the recording-standby mode to the maintenance mode. Then, in step S3, the rotary-body rotation controlling portion 132 causes the rotary body 58 to be rotated from the first angular position to the second angular position, so that the opposed surface 80 of the opposed portion 53 becomes opposed to the liquid ejection surface 10*a*.

Step S3 is followed by step S4 in which the rotary-body elevation controlling portion 133 controls the rotary-body elevating mechanism 56 such that the rotary body 58 is moved upwardly whereby the recessed member 52 is placed from the separation position to the contact position. As a result of placement of the recessed member 52 into the contact position, the distal end 54*a* of the peripheral portion 54 of the recessed member 52 is brought into contact with the liquid ejection surface 10*a*, so that the ejection space S1 opposed to the liquid ejection surface 10*a* is sealed from the exterior space S2.

In step S5, the liquid suction is carried out by causing the suction-pump controlling portion 136 to be activated, under control by the suction pump 77, such that the ink depositing on the liquid discharge area 81 of the opposed portion 58 is discharged to the waste liquid tank 78. By carrying out the liquid suction, the ink depositing on the liquid discharge area 81 is removed or reduced prior to the air humidification that is to be carried out in step S6 following step S5. Therefore, during the air circulation caused in the air humidification, it is possible to restrain the ink from flowing to the air discharge opening 30 and the air introduction opening 31, and to avoid the air discharge opening 30, the air introduction opening 31 and the circular passage (constituted by the tubes 65, 66, 67) from being clogged.

In step S6, the air humidification is carried out by causing the circulating pump 63 to be activated, under control by the circulating-pump controlling portion 135, such that the air circulation between the ejection space S1 and the tank 64 is caused. Specifically described, the air is collected from the ejection space S1 via the air discharge opening 30 by activating the circulating pump 63. In this instance, the air collected through the air discharge opening 30 is caused to reach the circulating pump 63 via a space within the tube 65 and then to reach the tank 64 via a space within the tube 66. This air is supplied into the lower space (i.e., space under the water level) of the tank 64. After having been humidified by the water within the tank 64, the water is discharged from the upper space of the tank 64, and is then supplied into the ejection space S1 via a space within the tube 67 and the air introduction opening 31. Owing to the introduction of the humidified air into the ejection space S1, it is possible to restrain evaporation of the ink in the vicinity of each of the liquid ejection openings 14*a* and to prevent clogging of each of the liquid ejection openings 14*a*. Further, even if the viscosity of the ink in the vicinity of each of the liquid ejection openings 14*a* is considerably increased, the viscosity of the ink can be reduced or normalized by moisture provided by the humidified air.

In step S6, in addition to the air humidification, the liquid suction is carried out by causing the suction pump 77 to be activated, under control by the suction-pump controlling portion 136, such that the ink depositing on the liquid discharge area 81 of the opposed portion 53 is discharged to the waste liquid tank 78. Thus, during the air circulation caused in the air humidification, it is possible to further restrain the liquid (depositing on the liquid discharge area 81) from flowing to the air discharge opening 30 and the air introduction opening 31. It is noted that, in the liquid suction carried out together with the air humidification, a suction force, which is generated by the suction pump 77, is adjusted to a level that does not impede the air circulation caused by the humidifier unit 60. It is further noted that, where the pressure within the ejection space S1 could be excessively reduced by the liquid suction, the upper space of the tank 64 may be held in communication with the atmosphere, i.e., the exterior space S2, for avoiding the excessive reduction of the pressure within the ejection space S1.

Step S6 is followed by step S7 that is implemented to determine whether the mode switching portion 131 has received the print command from the external device. While a negative judgment (NO) is obtained in step S7, namely, while the print command has not been received by the mode switching portion 131, step S7 is repeatedly implemented. On the other hand, when a positive judgment (YES) is obtained in step S7, namely, when the print command has been received by the mode switching portion 131, the control flow goes to step S8 in which the mode switching portion 131 switches the operation mode stored in the operation-mode storing portion 139, from the maintenance mode to the recording mode.

Step S8 is followed by step S9 in which the circulating-pump controlling portion 135 stops the activation of the circulating pump 63 so as to terminate the air humidification while the suction-pump controlling portion 136 stops the activation of the suction pump 77 so as to terminate the liquid suction.

Then, in step S10, the forced ink-ejection is carried out by the purging mechanism 8 under control by the forced-ejection controlling portion 137 such that the ink is purged from the head 10 toward the liquid discharge area 81 of the opposed surface 80. As a result of the forced ink-ejection, the ink is caused to deposit on the liquid discharge area 81. It is noted that, in step S11, the flushing may be carried out, in place of the purging, by the head 10 under control by the forced-ejection portion 137.

Then, in step S11, the liquid suction is carried out by activation of the suction pump 77 under control by the suction-pump controlling portion 136 such that the ink depositing on the liquid discharge area 81 of the opposed portion 53 can be discharged to the waste liquid tank 78. Thus, immediately after having been discharged onto the liquid discharge area 81 as a result of the forced ink-ejection, the ink is removed from the liquid discharge area 81, so that the liquid discharge area 81 is cleaned for thereby preventing the ink from being dried and avoiding the ink from sticking onto the liquid discharge area 81. That is, it is possible to prevent a situation where the ink sticking onto the liquid discharge area 81 serves as a drying stock when the air humidification is carried out. Further, each time the air humidification is carried out, the air circulation is caused with little ink existing in the liquid discharge area 81, so that it is possible to further restrain the ink from flowing to the air discharge opening 30 and the air introduction opening 31.

Step S11 is followed by step S12 in which the rotary-body elevation controlling portion 133 controls the rotary-body elevating mechanism 56 such that the rotary body 58 is moved downwardly whereby the recessed member 52 is moved downwardly from the contact position to the separation position. With the recessed member 52 being positioned in the separation position, the distal end 54*a* of the peripheral portion 54 of the recessed member 52 is separated from the liquid ejection surface 10*a*, so that the ejection space S1 opposed to the liquid ejection surface 10*a* is unsealed from the exterior space S2. It is noted that, in this step S12, after the recessed member 52 has been moved downwardly from the contact position to the separation position, the wiping is also carried out whereby foreign substances are removed from the liquid ejection surface 10*a* by the wiper 9 under control of the wiper controlling portion 138.

Then, in step S13, the rotary body rotation controlling portion 132 controls the rotary body 58 such that the rotary body 58 is rotated so as to be positioned from the second angular position to the first angular position so that the support surface 51*a* of the platen 51 becomes opposed to the liquid ejection surface 10*a*.

Then, in step S14, the print controlling portion 134 controls, in accordance with the print data supplied together with the print command, the head 10 and the sheet conveying mechanism 33, such that an image recording is performed for a sheet P. Step S14 is followed by step S15 in which, upon completion of the image recording, the mode switching portion 131 switches the operation mode stored in the operation-mode storing portion 139, from the maintenance mode to the recording mode. One cycle of execution of the control routine of FIG. 8 is completed with step S15, and then the control flow goes back to step S1.

As described above, in the present embodiment, the flow restraining plates 59 (each of which is provided between the liquid discharge area 81 and a corresponding one of the air discharge opening 30 and the air introduction opening 31) and the recessed portion 81*a* (which is provided in the liquid discharge area 81) constitute the respective flow restrainers. That is, in the printer 1 according to the present embodiment, there are two flow restrainers, one of which is constituted by the pair of the restraining plates 59 and the other of which is constituted by the recessed portion 81*a*. Thus, in the present embodiment, one of the two flow restrainers is provided between the liquid discharge area 81 and the outer peripheral area 82, and the other of the two flow restrainers is provided in the liquid discharge area 81, so that it is possible to restrain flow of the ink (that deposits on the liquid discharge area 81) to the air discharge opening 30 and the air introduction opening 31. Consequently, it is possible to restrain clogging of the air discharge opening 30, air introduction opening 31 and circular passage (tubes 65-67) with the ink, and also to restrain reduction of the performances of the circulating pump 68 and tank 64 (that constitutes a portion of the humidifier which has a function for humidifying the air and which is provided in the circular passage) due to undesirable flow of the ink to the circulating pump 63 and tank 64, for thereby restraining reduction of the humidifying function of the printer 1.

Further, in the present embodiment, prior to the air humidification (i.e., prior to the discharge of the air from the ejection space S1 through the air discharge opening 30 by activation of the humidifier), and during the air humidification (i.e., during the discharge of the air from the ejection space S1 through the air discharge opening 30 by activation of the humidifier), the suction pump 77 is activated, under control by the controller 100, to suck the ink (depositing on the liquid discharge area 81) through the liquid suction opening 74 (provided in the liquid discharge area 81) so that the sucked ink is discharged out of the ejection space S1 through the liquid suction opening 74. It is therefore possible to further restrain the ink (depositing on the liquid discharge area 81) from flowing to the air discharge opening 30 and the air introduction opening 31.

Figure 9:
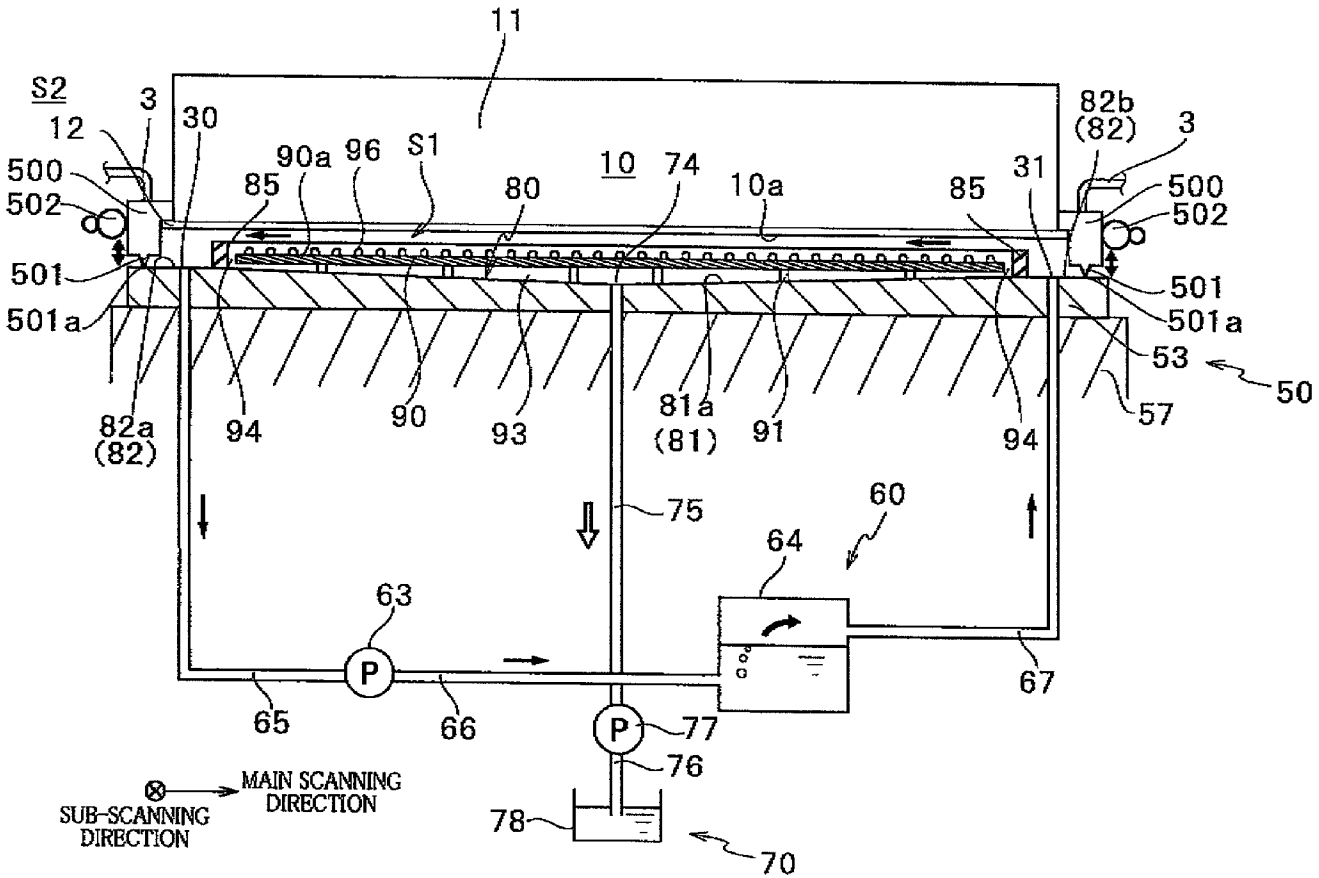
FIG. 9 is a view corresponding to the view of FIG. 5 and showing an inkjet printer that is constructed according to a second embodiment of the invention.

Referring next to FIGS. 8 and 9, there will be described a printer constructed according to a second embodiment of the invention. The printer according to the second embodiment is different from the printer according to the first embodiment with respect to construction of the cap device. Specifically described, in the first embodiment, the cap device establishes selectively the sealing state and the unsealing state, by vertically moving the recessed member 52. On the other hand, in the second embodiment, the sealing state and the unsealing state are selectively established by vertically moving a movable peripheral body 500 that is provided in the head holder 3. Further, the printer of the second embodiment is different from the printer of the first embodiment in that a cap tip 90 is provided in the liquid discharge area 81. In the following description of the second embodiment, the same reference signs as used in the description of the first embodiment are used to identify the same components or elements, which will not be described to avoid redundancy of the description.

In the present second embodiment, as shown in FIG. 9, the cap fixing member 57 is provided with, in place of the recessed member 52, the opposed portion 53 without the peripheral portion 54. The support/cap unit 50 includes the movable peripheral body 500 in place of the rotary-body elevating mechanism 56.

In the first embodiment, the opposed portion 53 is provided with the flow restraining plates 59 as the protrusion walls. However, in the present second embodiment, the opposed portion 53 is provided with, in place of the flow restraining plates 59, a frame-like flow restraining plate 85 as the protrusion wall which protrudes upwardly from the opposed portion 53 and which surrounds the liquid discharge area 81. The plate-like cap tip 90 is provided in the liquid discharge area 81 of the opposed portion 53, for increasing efficiency of suction of the ink by the suction pump 77. It is noted that, in the present second embodiment, the opposed portion 53 is slightly larger than the liquid ejection surface 10*a*, as measured in the main scanning direction and also in the sub-scanning direction.

The cap tip 90 is fixed onto a plurality of protrusions 91 that are provided in the liquid discharge area 81 of the opposed surface 80, so that a space 93 is defined between the cap tip 90 and the opposed surface 80. Further, the cap tip 90 is fixed onto the protrusions 91 such that the cap tip 90 cooperates with an inner circumferential surface of the frame-like flow restraining plate 85 to define a clearance 94 therebetween. The amount of the clearance 94 is suitable for causing a capillary phenomenon therein.

Figure 10:
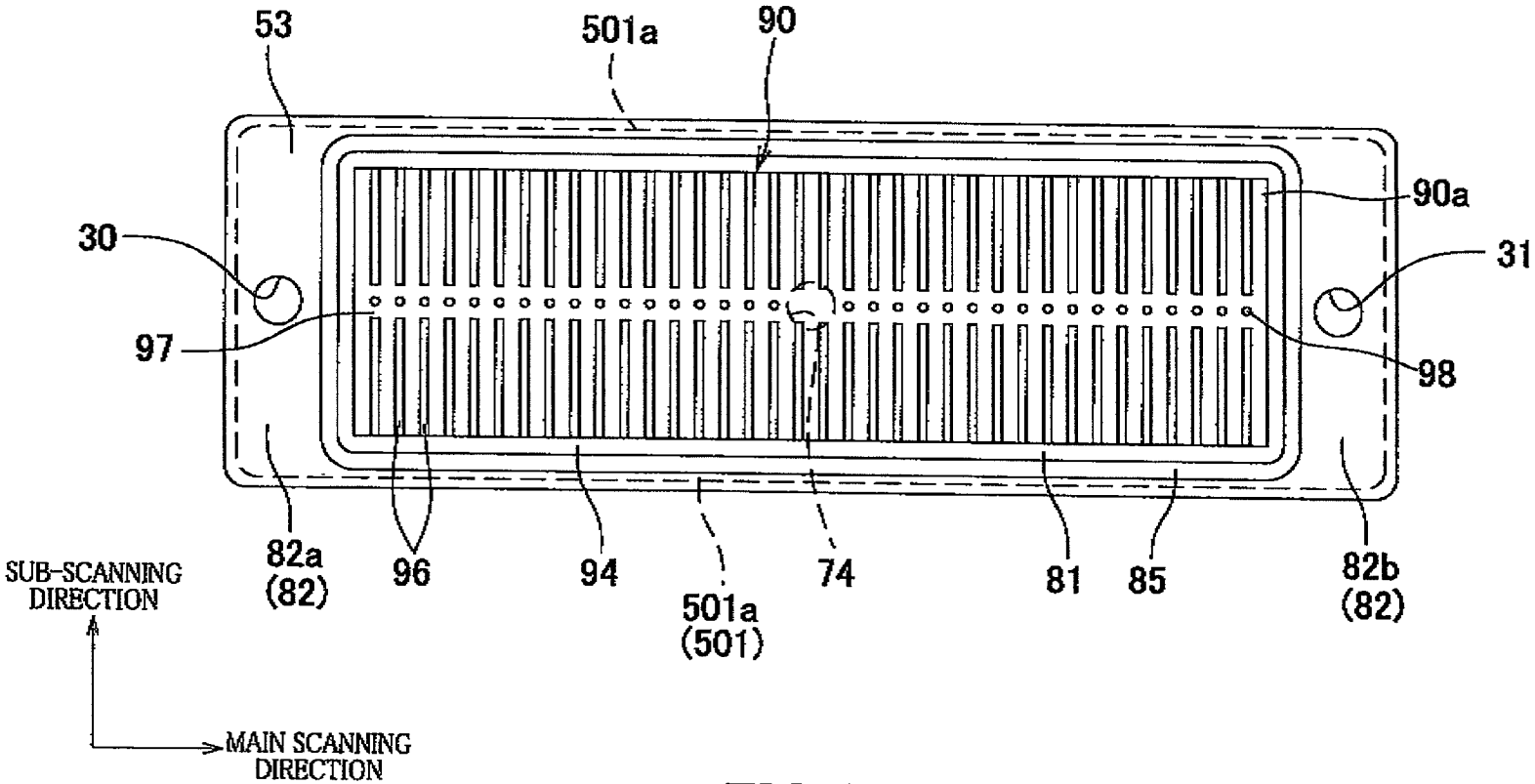
FIG. 10 is an upper plan view showing a support/cap unit included in the inkjet printer of FIG. 9.

The cap tip 90 has an upper surface 90*a* that constitutes the liquid discharge area onto which the ink ejected from the liquid ejection surface 10*a* lands (deposits). Further, as shown in FIG. 10, a plurality of protrusions (ridges) 96 are disposed on the upper surface 90*a* of the cap tip 90. The protrusions 96, each of which extends between opposite ends of the upper surface 90*a* in the sub-scanning direction, are arranged at a constant interval in the main scanning direction. When the ink is sucked by activation of the suction pump 77, the ink discharged onto the upper surface 90*a* of the cap tip 90 is gathered, owing to a surface tension, at corners defined between side surfaces of the protrusions 96 and the upper surface 90*a*, and the gathered ink is attracted into the clearance 94 by the capillary phenomenon. Then, the ink attracted into the clearance 94 is caused to flow into the space 93. Thus, it is possible to restrain the ink from staying on the upper surface 90*a* of the cap tip 90, and also to efficiently suck the ink (depositing on the liquid discharge area 81 and the cap tip 90) by maintaining the high level of the suction force of the suction pump 77.

In a central portion of the upper surface 90*a* of the cap tip 90 in the sub-scanning direction, a plurality of slits 97 are provided for cutting off extensions of the respective protrusions 96. That is, each of the elongated protrusions 96 is divided by the corresponding slit 97 into two portions that are spaced apart from each other in the sub-scanning direction. Each of the protrusions 96 has a top surface, which is rounded for restraining the ink from remaining on the top surface of the protrusion 96. It is noted that the top surface of each protrusion 96 may be chamfered at its periphery so that the top surface includes a sloped surface portion at its periphery. In this arrangement, it is possible to restrain the ink from remaining on the protrusion 96, as in the arrangement with the rounded top surface.

Further, the cap tip 90 has a plurality of through-holes 98 interconnecting the upper and lower surfaces of the cap tip 90, as shown in FIG. 10, so that the ink can be caused to flow into the space 93 also via the plurality of through-holes 98. The plurality of through-holes 98 are arranged in the main scanning direction. The openings of the respective through-holes 98, which open in the upper surface 90*a*, are located in the slits 97. Described precisely, the openings of the respective through-holes 98 are located in the slits 97 except two of the slits 97 which overlap with the liquid suction opening 74 in a plan view. Each of the openings of the through-holes 98 is smaller in area than the liquid suction opening 74. Any one of the openings of the through-holes 98 does not overlap with the liquid suction opening 74 as seen in the vertical direction, so that it is possible to restrain reduction of the suction force that is transmitted from the suction pump 77 via the liquid suction opening 74.

A connection between the upper surface 90*a* of the cap tip 90 and one of side surfaces of the cap tip 90, which are opposite to each other in the sub-scanning direction, is rounded. A connection between the upper surface 90*a* of the cap tip 90 and the other of the side surfaces of the cap tip 90 is also rounded. The rounded connections facilitate the ink to flow into the clearance 94 between the cap tip 90 and the inner circumferential surface of the frame-like flow restraining plate 85. It is noted that the connections between the upper surface 90*a* of the cap tip 90 and the side surfaces of the cap tip 90 may be chamfered instead of being rounded so that the top surface 90*a* includes a sloped surface portion at its periphery. In this modification, too, the ink is facilitated to flow into the clearance 94.

The movable peripheral body 500 attached to the head holder 3 will be described in detail. The movable peripheral body 500 is constituted by an elastic member, and has a frame-like shape so as to surround the liquid ejection surface 10*a* of the head 10 in a plan view. A protrusion 501 is provided on a lower surface of the movable peripheral body 500. The protrusion 501 has an inverted-triangular shape in its cross section.

The movable peripheral body 500 is vertically movable by rotation of gears 502, so as to be positioned selectively in an upper position and a lower position. When the peripheral body 500 is being positioned in the upper position, the protrusion 501 is positioned on an upper side of the liquid ejection surface 10*a*. When the peripheral body 500 is being positioned in the lower position (as shown in FIG. 9), the protrusion 501 is positioned on a lower side of the liquid ejection surface 10*a*. The controller 100 controls the gears 502, such that the movable peripheral body 500 is positioned in the lower position when the maintenance mode is being stored as the operation mode in the operation-mode storing portion 139, and such that the movable peripheral body 500 is positioned in the upper position except when the maintenance mode is being stored as the operation mode in the operation-mode staring portion 139.

When the movable peripheral body 500 is being positioned in the lower position, the ejection space S1 is sealed from the exterior space S2 by contact of a distal end 501*a* of the protrusion 501 with the outer peripheral area 82 of the opposed surface 80, as shown in FIG. 9. When the movable peripheral body 500 is being positioned in the upper position, the ejection space S1 is not sealed from the exterior space S2 by separation of the distal end 501*a* of the protrusion 501 from the outer peripheral area 82 of the opposed surface 80. In the present second embodiment, the movable peripheral body 500, gears 502, opposed portion 53 and controller 100 cooperate to constitute the cap device.

As described above, in the present second embodiment, the frame-like flow restraining plate 85, which is disposed between the liquid discharge area 81 and each of the air discharge and instruction openings 30, 31, constitutes one of the flow restrainers, and the recessed portion 81*a* provided in the liquid discharge area 81 of the opposed surface 80 constitutes another one of the flow restrainers. In the present second embodiment, owing to the flow restrainer, it is possible to restrain the ink (depositing on the liquid discharge area 81) from flowing to the air discharge opening 30 and the air introduction opening 31. Further, owing to the cap tip 90 provided in the liquid discharge area 81, the ink depositing on the liquid discharge area 81 and the upper surface of the cap tip 90 can be further efficiently sucked by the liquid sucker, whereby the flow of the ink to the air discharge and introduction openings 30, 31 can be further restrained.

Figure 11:
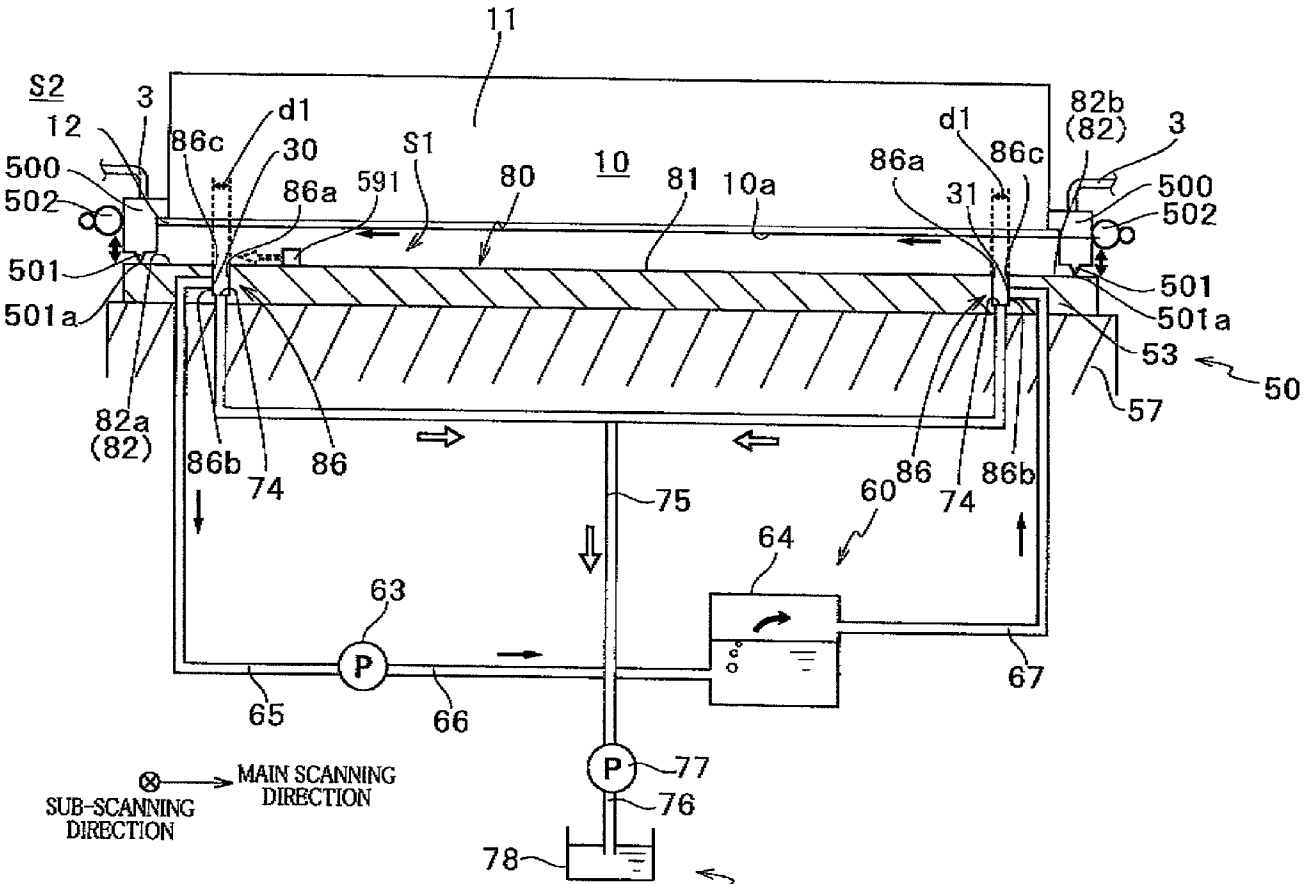
FIG. 11 is a view corresponding to the view of FIG. 5 and showing an inkjet printer that is constructed according to a third embodiment of the invention.

Referring next to FIG. 11, there will be described a printer constructed according to a third embodiment of the invention. The printer according to the third embodiment is different from the printer according to the above-described second embodiment with respect to the following points. Firstly, while the frame-like flow restraining plate 85 is disposed to surround the liquid discharge area 81 in the second embodiment, a peripheral recess 86 is provided in the opposed portion 53 in the third embodiment. Secondly, the printer is provided with a wiper 591 which extends in the sub-scanning direction and which is movable in the main scanning direction by a movement mechanism (not shown). During the liquid suction, the wiper 591 is moved, under control by the wiper controlling portion 188, in the main scanning direction, while being held in contact with the liquid discharge area 81, whereby the ink depositing on the liquid discharge area 81 is caused to flow into the peripheral recess 86. Further, in the third embodiment, the liquid suction openings 74 are located in a bottom surface 86*b* of the peripheral recess 86, rather than in the liquid discharge area 81. Moreover, in the third embodiment, neither the recessed portion 81*a* nor the cap tip 90 is provided in the liquid discharge area 81.

In the present third embodiment, the peripheral recess 86 is provided in the opposed portion 53 such that the liquid discharge area 81 is surrounded by the peripheral recess 86. When the liquid suction is being carried out, the ink depositing on the liquid discharge area 81 is caused, by movement of the wiper 591 in the main scanning direction, to flow down to the bottom surface 86*b* of the peripheral recess 86 via an inside surface 86*a* of the peripheral recess 86, i.e., via a side surface of the peripheral recess 86, which is located on the side of the liquid discharge area 81.

The liquid suction openings 74 are provided in respective portions of the bottom surface 86*b* of the peripheral recess 86, which are opposite to each other in the main scanning direction. The ink flowing onto the bottom surface 86*b* is sucked by activation of the liquid suction unit 70, and is caused to flow out of the ejection space S1 via the liquid suction openings 74. In the present third embodiment, the liquid suction unit 70, wiper 591 and controller 100 cooperate to constitute a liquid remover.

The air discharge opening 30 and the air introduction opening 31 are provided in an inside surface 86*c* of the peripheral recess 86, i.e., a side surface of the peripheral recess 86, which is located on the side of the periphery of the opposed portion 53, such that the air discharge opening 30 and the air introduction opening 31 are located in respective end portions of the opposed portion 53, which are opposite to each other in the main scanning direction. It is noted that the air discharge opening 30 and the air introduction opening 31 are located in height that avoids the ink (that flows onto the bottom surface 86*b* of the peripheral recess 86) from reaching the openings 30, 31. That is, the openings 30, 31 are vertically distant from the bottom surface 86*b* by a sufficient distance.

Further, a velocity of movement of the wiper 591 and a width d1 of the bottom surface 86*d* (which corresponds to a distance between the inside surfaces 86*a*, 86*c* of the peripheral recess 86 in the main scanning direction) are suitably determined such that the ink wiped by the wiper 591 from the liquid discharge area 81 into the peripheral recess 86 is not caused to directly reach the air discharge opening 30 and the air introduction opening 31.

In the present third embodiment, owing to the peripheral recess 86 and the liquid remover, the ink depositing on the liquid discharge area 81 can be retrained from flowing to the air discharge opening 30 and the air introduction opening 31. Further, during the liquid suction, the wiper 591 is controlled by the wiper controlling portion 138 such that the ink existing in the liquid discharge area 81 can be reduced and such that the ink wiped onto the bottom surface 86*b* of the peripheral recess 86 can be sucked out of the ejection space S1 by activation of the liquid suction unit 70. It is therefore possible to restrain the ink depositing on the liquid discharge area 81, from flowing to the air discharge opening 30 and the air introduction opening 31, during the air humidification.

In the present third embodiment, the air discharge opening 30 and the air introduction opening 31 are provided in the inside surface 86*c* of the peripheral recess 86. However, these openings 30, 31 may be provided in the outer peripheral area 82 or the outside area 82*b* of the opposed surface 80. Further, in the present third embodiment, the ink depositing on the liquid discharge area 81 is caused, by the wiper 591, to flow into the peripheral recess 86. However, the ink depositing on the liquid discharge area 81 may be caused, by other means, to flow into the peripheral recess 86.

Figure 12:
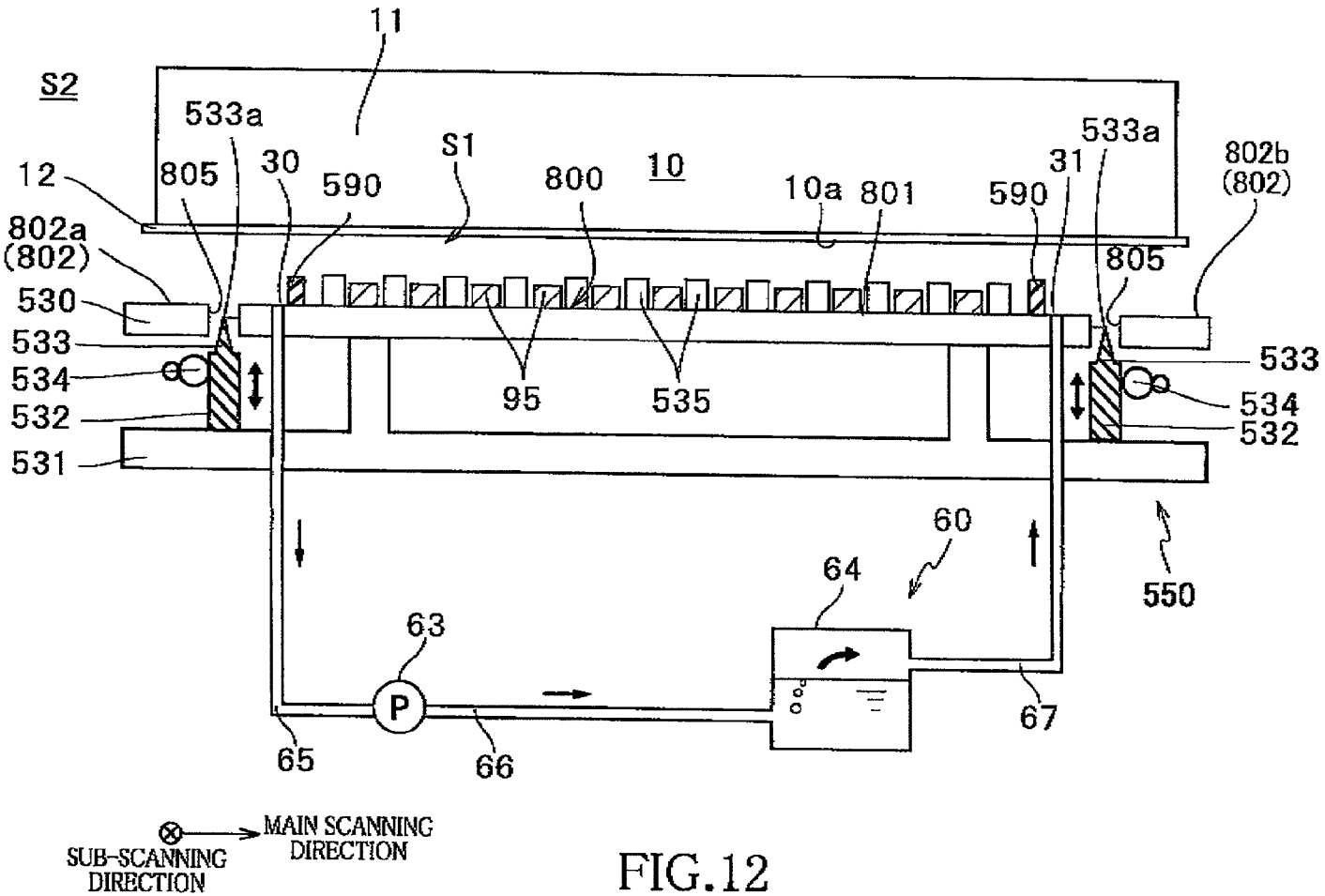
FIG. 12 is a view corresponding to the view of FIG. 5 and showing an inkjet printer that is constructed according to a fourth embodiment of the invention.
Figure 13:
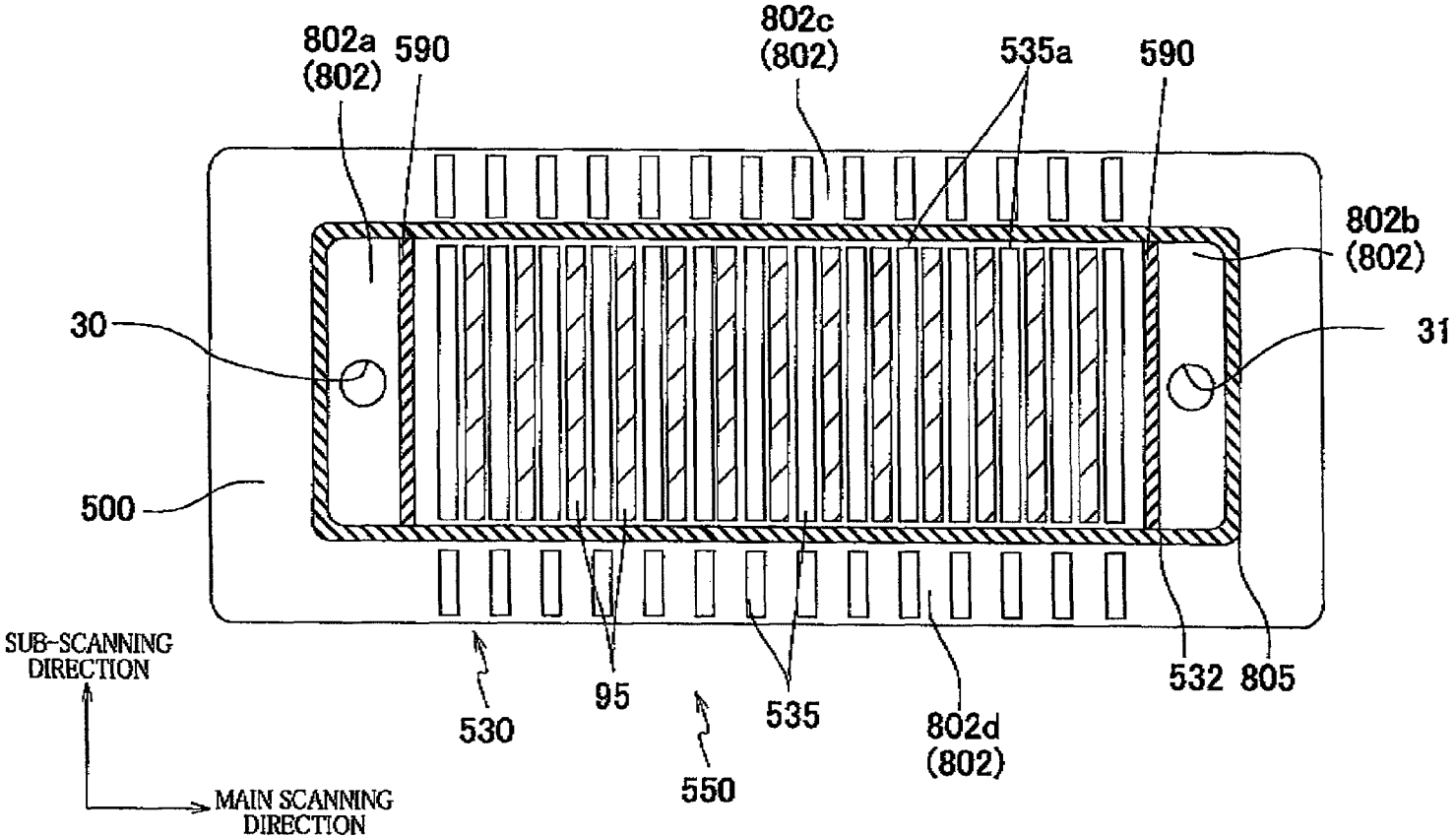
FIG. 13 is an upper plan view showing a cap unit of FIG. 12.

Referring next to FIGS. 12 and 13, there will be described a printer constructed according to a fourth embodiment of the invention. The printer according to the fourth embodiment of the invention is different from each of the printers according to the first through third embodiments of the invention, principally, in that the printer of the fourth embodiment has a support/cap unit 550 in place of the support/cap unit 50. The support/cap unit 550 does not include a rotary body, unlike the support/cap unit 50 including the rotary body 58. That is, in the first through third embodiments, the opposed portion 53 as a component of the cap device is not opposed to the liquid ejection surface 10*a* during the recording mode, and is opposed to the liquid ejection surface 10*a* during the maintenance mode. However, in the fourth embodiment, an opposed portion 530 as a component of the cap device is opposed to the liquid ejection surface 10*a* not only during the maintenance mode but also during the recording mode. Further, the printer of the fourth embodiment is different from each of the printers of the first through third embodiments also in that the liquid discharge area is provided with liquid absorbers 95 as the flow restrainer in place of the recessed portion 81*a*. It is noted that the printer of the fourth embodiment does not have the liquid suction unit 70. In the following description of the fourth embodiment, the same reference signs as used in the description of the first embodiment are used to identify the same components or elements, which will not be described to avoid redundancy of the description.

In the present fourth embodiment, as shown in FIGS. 12 and 13, the cap unit 550 includes an opposed portion 530, a fixing member 531 and a movable peripheral body 532. The opposed portion 530 is located in a position that is vertically fixed by the fixing member 531. The movable peripheral body 532 is attached to the fixing member 531.

The opposed portion 530 has a size slightly larger than a size of the liquid ejection surface 10*a*, as measured in the main scanning direction and the sub-scanning direction. The opposed portion 530 has, as its upper surface, an opposed surface 800 that is opposed to the liquid ejection surface 10*a*. The opposed surface 800 is sectioned into a liquid discharge area 801 and an outer peripheral area 802 that surrounds the liquid discharge area 801. The liquid discharge area 801 is an area onto which the ink discharged (forcedly ejected) through the liquid ejection openings 14*a* is to be delivered (caused to deposit or land). The outer peripheral area 802 is an area onto which the ink ejected through the liquid ejection openings 14*a* is not to be delivered (caused to deposit or land), and is constituted mainly by a pair of outside areas 802*a*, 802*b* that are located on respective opposite sides of the liquid discharge area 801 in the main scanning direction and also another pair of outside areas 802*c*, 802*d* that are located on respective opposite sides of the liquid discharge area 801 in the sub-scanning direction.

As shown in FIG. 12, the air discharge opening 30 is provided in the outside area 802*a* of the opposed surface 800 while the air introduction opening 31 is provided in the outside area 802*b* of the opposed surface 800. Further, a peripheral opening (slot) 805 is provided in the outer peripheral area 802 of the opposed surface 800, such that the air discharge opening 30, air introduction opening 31 and liquid discharge area 801 are surrounded by the peripheral opening 805 in a plane view.

A flow restraining plate 590 is provided in a portion of the outside area 802*a* of the opposed surface 800 that is between the air discharge opening 30 and the liquid discharge area 801. Another flow restraining plate 590 is provided in a portion of the outside area 802*b* of the opposed surface 800 that is between the air introduction opening 31 and the liquid discharge area 801. Each of the flow restraining plates 590 protrudes from the opposed surface 800, and extends in the sub-scanning direction. It is noted that each of the flow restraining plates 590 has end portions which are opposite to each other in the sub-scanning direction and which are located in positions lying at an inner periphery of the peripheral opening 805, as shown in FIG. 13. Further, a multiplicity of ribs 535 are provided on the opposed surface 800 of the opposed portion 530, as shown in FIG. 13. The ribs 535 extend in the sub-scanning direction from one of end portions of the opposed surface 800 which are opposite to each other in the sub-scanning direction, to the other of the end portions of the opposed surface 800. The ribs 535 are located in an area between the pair of flow restraining plates 590 in the main scanning direction, and are arranged at a constant interval in the main scanning direction. It is further noted that each of the ribs 535 is provided with slits 535 which are located in positions aligned with the peripheral opening 805 and which cut off extension of the rib 535. Each of the ribs 535 has, as an upper surface, a support surface for supporting the sheet P. The upper surface of each rib 535 is rounded for restraining the ink from remaining on the upper surface of the rib 535.

The ink absorbers 95 are provided in respective portions of the liquid discharge area 801 each of which is defined between a corresponding pair of ribs 535 adjacent to each other. Each of the ink absorbers 95 is constituted by a porous body (e.g., sponge, urethane, unwoven fabric) that is capable of holding the ink. Therefore, the ink ejected toward the liquid discharge area 801 through the liquid ejection openings 14*a* is held in the ink absorber 95, so that it is possible to restrain the ink depositing on the liquid discharge area 801, from flowing to the air discharge opening 30 and air introduction opening 31.

The movable peripheral body 532 attached to the fixing member 531 will be described in detail. The movable peripheral body 532 is constituted by an elastic member, and corresponds to a peripheral portion that is to be slidingly introduced into the peripheral opening 805 that opens also in a lower surface of the oppose portion 530. A protrusion 533 is provided on an upper end surface of the movable peripheral body 532. The protrusion 533 has an inverted-triangular shape in its cross section.

The movable peripheral body 532 is vertically movable by rotation of gears 584, so as to be positioned selectively in an upper position and a lower position. When the peripheral body 534 is being positioned in the upper position, a distal end 533*a* of the protrusion 533 is held in contact with the liquid ejection surface 10*a*. When the peripheral body 500 is being positioned in the lower position (see FIG. 12), the distal end 533*a* of the protrusion 533 is positioned on a lower side of the opposed surface 800. The controller 100 controls the gears 534, such that the movable peripheral body 532 is positioned in the upper position when the maintenance mode is being stored as the operation mode stored in the operation-mode storing portion 139, and such that the movable peripheral body 532 is positioned in the lower position except when the maintenance mode is being stored as the operation mode stored in the operation-mode storing portion 139.

When the movable peripheral body 532 is being positioned in the upper position, the ejection space S1 is sealed from the exterior space S2 by contact of the distal end 533*a* of the protrusion 533 with the liquid ejection surface 10*a*. It is noted that, when the movable peripheral body 532 is being positioned in the upper position, an inside surface of the movable peripheral body 532 is held in contact with opposite end portions of each of the flow restraining plates 590. In the present fourth embodiment, the movable peripheral body 532 and the flow restraining plates 590 cooperate to constitute the surrounding portion.

When the movable peripheral body 532 is being positioned in the lower position, the ejection space S1 is unsealed from the exterior space S2 by separation of the distal end 583*a* of the protrusion 533 from the opposed surface 800. In the present fourth embodiment, the opposed portion 530, movable peripheral body 532 and controller 100 cooperate to constitute the cap device.

As described above, in the present fourth embodiment, the flow restraining plates 590 (each of which is provided between the liquid discharge area 81 and a corresponding one of the air discharge opening 30 and the air introduction opening 31) and the ink absorbers 95 (which are provided in the liquid discharge area 81) constitute the respective flow restrainers. Owing to the flow restrainers, it is possible to restrain the ink depositing on the liquid discharge area 81, from flowing to the air discharge opening 30 and the air introduction opening 31.

While the presently preferred embodiments of the invention have been described above in detail, it is to be understood that the invention is not limited to the details of the illustrated embodiments, but may be otherwise embodied without departing from the scope and spirit of the invention defined in the appended claims. For example, in each of the above-described embodiments, the humidifier unit 60 is constructed to include the circulating pump 68 and the tank 64. However, the humidifier unit 60 may be otherwise constituted as long as the humidifier unit 60 is capable of humidifying the air within the circular passage. For example, the humidifier unit 60 may be constituted by the tank 64 without the circulating pump 63. Further, the humidifier unit 60 may additionally include a heater or other heating means, or may be constituted by a supersonic humidifier. Moreover, it is possible to humidify the air by disposing water-containing cloth or porous body (e.g., wet sponge) in the circular passage.

Further, in the humidifier in each of the above-described embodiments, the air discharged from the ejection space S1 via the air discharge opening 30 is collected via the circular passage (tubes 65-67), and the collected air is reused. However, the collected air may be discharged to the exterior space S2 without the collected air being reused.

Further, the air discharge opening 30 and the air introduction opening 31 are provided in the opposed surface of the opposed portion in each of the above-described embodiments. However, this arrangement may be modified as needed. For example, the air discharge opening 30 and the air introduction opening 31 may be provided in the peripheral portion rather than in the opposed portion. It is noted that, even in an arrangement in which the air discharge opening 30 and/or the air introduction opening 31 are provided in the peripheral portion, there is a risk that the fluid such as the ink depositing on the opposed surface 80 of the opposed portion 53 could flow to the air discharge opening 30 and/or the air introduction opening 31.

Further, each of the flow restrainers is not limited to the above-described details, and may be modified as needed, as long as it is capable of restraining the liquid discharged onto the liquid discharge area 81, from flowing to the air discharge opening 30 and the air introduction opening 31. The number of the flow restrainer or restrainers provided in the printer is not particularly limited, and may be only one or two or more.

Further, in each of the above-described embodiments, the liquid remover is constructed to include the liquid sucker configured to suck the ink from the ejection space via the liquid suction opening or openings 74. However, the liquid remover may be otherwise constructed, as long as it is capable of removing the ink depositing on the liquid discharge area 81.

Further, in each of the above-described embodiments, the liquid suction is carried out by the suction pump 77 that is activated under control by the suction-pump controlling portion 136 such that the ink depositing on the liquid discharge area 81 of the opposed portion 53 is discharged into the waste liquid tank 78 while the ejection space S1 opposed to the liquid ejection surface 10*a* is sealed from the exterior space S2. However, the liquid suction may be carried out, without the ejection space S1 being sealed from the exterior space S2.

Further, in each of the above-described first through third embodiments, when the mode switching portion 131 switches the operation mode stored in the operation-mode storing portion 139, from the recording mode to the maintenance mode, the rotary-body rotation controlling portion 132 causes the rotary body 53 to be rotated for placing the rotary body 58 from the first angular position into the second angular position. However, for avoiding collision of the platen 51 or the recessed member 52 with the liquid ejection surface 10*a* during rotation of the rotary body 58, the rotary-body elevation controlling portion 133 may control the rotary-body elevating mechanism 56 such that the rotary body 58 is moved downwardly by a required distance prior to the rotation of the rotary body 58.

Further, each of the above-described first through third embodiments may be modified such that, when the operation mode is switched from the recording mode to the maintenance mode, the platen 51 (rather than the support/cap unit 50 including the rotary body 58) is moved downwardly while the recessed member 52 is moved in the main scanning direction so as to be positioned in a position between the liquid ejection surface 10*a* and the downwardly moved platen 51, and then the distal end 54*a* of the peripheral portion 54 of the recessed member 52 is brought into contact with the liquid ejection surface 10*a*.

It is noted that, in each of the above-described first through third embodiments, the vertical positional relationship between the circulating pump 63 and the tank 64 in the humidifier unit 60 and the vertical positional relationship between the suction pump 77 and the waste liquid pump 78 in the liquid suction unit 70 are not changed by the rotation of the rotary body 58.

Further, the present invention is applicable not only to a monochrome printer but also a color printer, and is applicable to both of a line type printer and a serial type printer. Still further, the present invention is applicable not only to a printer but also to other apparatus such as a facsimile machine and a copy machine. Moreover, the invention is applicable also to a recording apparatus having a head configured to eject a liquid other than an ink and a recording apparatus having two or more recording heads. The recording medium does not necessarily have to be a sheet P but may be any other kind of medium that is usable for recording images or characters.

What is claimed is:

1. A liquid ejection apparatus comprising:

a liquid ejection head having a liquid ejection surface, and configured to eject ink onto a liquid discharge area through liquid ejection openings that open in said liquid ejection surface, for forming an image on a recording medium;

a cap device configured to establish a sealing state and an unsealing state, said cap device comprising an opposed portion disposed opposite said liquid ejection surface and a peripheral portion disposed at a periphery of the opposed portion such that an ejection space between said liquid ejection surface and said cap device is sealed from an exterior space by cooperation of said liquid ejection surface, said opposed portion, and said peripheral portion when the sealing state is established and the ejection space is unsealed from the exterior space when the unsealing state is established;

an air introduction opening and an air discharge opening that are located in said cap device, said air discharge opening being configured to open in an area other than said liquid discharge area when the sealing state is established;

a humidifier configured to supply humidified air into said ejection space through said air introduction opening and to discharge air from said ejection space through said air discharge opening; and at least one flow restrainer configured to restrain the liquid having been discharged onto said liquid discharge area from flowing to said air discharge opening.

2. The liquid ejection apparatus according to claim 1, wherein said at least one flow restrainer is either disposed in said liquid discharge area or disposed between said liquid discharge area and said air discharge opening.

3. The liquid ejection apparatus according to claim 1, further comprising a circular passage that is held in communication with said air introduction opening and said air discharge opening through respective opposite end portions of said circular passage, wherein:

said humidifier includes a portion which has a function for humidifying the air and which is provided in said circular passage, said humidifier is configured to collect air from said ejection space through said air discharge opening and said circular passage and to humidify the air collected in said portion of said humidifier, and said humidifier is configured to supply the humidified air into said ejection space through said circular passage and said air introduction opening.

4. The liquid ejection apparatus according to claim 1, wherein said air introduction opening is located in an area other than said liquid discharge area, and wherein said at least one flow restrainer is configured to restrain the liquid having been discharged onto said liquid discharge area from flowing to said air introduction opening.

5. The liquid ejection apparatus according to claim 1, wherein said at least one flow restrainer includes a surrounding portion which is disposed on said opposed portion and which surrounds said liquid discharge area.

6. The liquid ejection apparatus according to claim 1, wherein said cap device includes a recessed member constituted by said opposed portion and a peripheral portion that is formed integrally with said opposed portion, and wherein said peripheral portion has a distal end portion, which is configured to be held in contact with said liquid ejection surface when the sealing state is being established.

7. The liquid ejection apparatus according to claim 1, wherein said at least one flow restrainer includes a liquid absorber that is capable of absorbing the liquid having been discharged onto said liquid discharge area, and wherein said liquid absorber is provided in said liquid discharge area.

8. The liquid ejection apparatus according to claim 1, wherein said at least one flow restrainer includes a liquid remover configured to remove the liquid having been discharged onto said liquid discharge area.

9. The liquid ejection apparatus according to claim 8, wherein said liquid remover includes a liquid sucker configured to suck the liquid having been discharged onto said liquid discharge area through a liquid suction opening that is provided in said liquid discharge area such that the sucked liquid is discharged out from said ejection space.

10. The liquid ejection apparatus according to claim 9, wherein said liquid sucker is configured to suck the liquid through said liquid suction opening such that the sucked liquid is discharged out from said ejection space before the air is discharged from said ejection space by said humidifier.

11. The liquid ejection apparatus according to claim 9, wherein said liquid sucker is configured to suck the liquid through said liquid suction opening such that the sucked liquid is discharged out from said ejection space when the air is being discharged from said ejection space by said humidifier.

12. The liquid ejection apparatus according to claim 1, wherein said liquid ejection openings are located in an ejection-opening portion of said liquid ejection surface, and wherein said air introduction opening and said air discharge opening are positioned in respective positions, which are located on respective opposite sides of said ejection-opening portion of said liquid ejection surface, as seen in a direction perpendicular to said liquid ejection surface, when the sealing state is established by said cap device.

13. The liquid ejection apparatus according to claim 1, wherein said opposed portion is sectioned into said liquid discharge area and said area other than said liquid discharge area.

14. The liquid ejection apparatus according to claim 13, wherein said at least one flow restrainer includes a protrusion wall which is provided between said liquid discharge area and said air discharge opening and which protrudes from said opposed portion.

15. The liquid ejection apparatus according to claim 1, wherein said peripheral portion has a distal end portion that is configured to be held in contact with said liquid ejection surface when the sealing state is established.

16. The liquid ejection apparatus according to claim 1, wherein said peripheral portion has a distal end portion that is configured to be held in contact with said opposed portion when the sealing state is established.

17. The liquid ejection apparatus according to claim 1, wherein said at least one flow restrainer is located within said peripheral portion in a direction parallel with said liquid ejection surface when the sealing state is established.

18. The liquid ejection apparatus according to claim 1, wherein said at least one flow restrainer is located in a position lower than said liquid ejection surface when the sealing state is established.

19. The liquid ejection apparatus according to claim 1, wherein said air discharge opening opens toward said liquid ejection surface.

20. The liquid ejection apparatus according to claim 1, wherein said introduction opening and said air discharge opening are isolated from the exterior space when the sealing state is established.

21. The liquid ejection apparatus according to claim 1, wherein said humidifier includes a tank that stores the air, and wherein said air introduction opening and said air discharge opening are in communication with said tank of said humidifier such that the humidified air is supplied from said tank into said ejection space through said air introduction opening, and such that the air is to be discharged from said ejection space into said tank through said air discharged opening.

22. The liquid ejection apparatus according to claim 1, wherein said at least one flow restrainer is located within said peripheral portion in a direction parallel with said liquid ejection surface.

23. The liquid ejection apparatus according to claim 1, wherein said at least one flow restrainer has a vertical length that is less than a vertical length of the peripheral portion.

* * * * *